US011359412B2

(12) United States Patent
Raz

(10) Patent No.: US 11,359,412 B2
(45) Date of Patent: Jun. 14, 2022

(54) LATCH ARRANGEMENT HAVING A STOP LATCH

(71) Applicant: DAN RAZ LTD., Tirat Carmel (IL)

(72) Inventor: Amir Raz, Tirat Carmel (IL)

(73) Assignee: DAN RAZ LTD., Tirat Carmel (IL)

( * ) Notice: Subject to any disclaimer, the term of this patent is extended or adjusted under 35 U.S.C. 154(b) by 192 days.

(21) Appl. No.: 16/595,521

(22) Filed: Oct. 8, 2019

(65) Prior Publication Data

US 2020/0032553 A1 Jan. 30, 2020

Related U.S. Application Data

(63) Continuation of application No. 15/059,373, filed on Mar. 3, 2016, now Pat. No. 10,487,545.

(51) Int. Cl.
*E05B 63/00* (2006.01)
*E05B 63/24* (2006.01)
(Continued)

(52) U.S. Cl.
CPC ..... *E05B 63/0052* (2013.01); *E05B 17/2007* (2013.01); *E05B 17/2053* (2013.01); *E05B 17/2057* (2013.01); *E05B 63/24* (2013.01); *E05B 65/06* (2013.01); *E05B 65/0835* (2013.01); *E05C 3/16* (2013.01);
(Continued)

(58) Field of Classification Search
CPC ..... E05B 17/2007; E05B 17/2053; E05B 17/2057; E05B 63/24; E05B 63/0052; E05B 65/06; E05B 65/0835; E05B 65/1066; E05C 3/16; E05C 19/002; E05C 2001/008; Y10T 292/1039; Y10T 292/104; Y10T 292/1041; Y10T 292/1021; Y10T 292/1089
See application file for complete search history.

(56) References Cited

U.S. PATENT DOCUMENTS 112,635 A * 3/1871 Robinson ..... E05C 19/10 292/106
293,248 A * 2/1884 Holland ..... E05C 1/06 70/154
(Continued)

FOREIGN PATENT DOCUMENTS

AU 627346 8/1992
AU 641561 9/1993
(Continued)

*Primary Examiner* — Carlos Lugo
(74) *Attorney, Agent, or Firm* — Mark M. Friedman

(57) ABSTRACT

A latch arrangement for fastening a panel of a door or a window to a frame element, the panel including a depression is provided. The latch arrangement includes a locking element pivotally mounted an the frame element and displaceable between a locked position in which the locking element is engaged with the depression of the panel locking thereby the panel to the frame element, and an unlocked position in which the locking element is disengaged from the depression of the panel unlocking thereby the panel from the frame element, a stop latch selectively deployable to secure the locking element in the locked position, precluding thereby displacement of the locking element to the unlocked position; and an actuating mechanism configured to selectively pivot the locking element away from the depression to the unlocked position.

21 Claims, 21 Drawing Sheets

(51) Int. Cl.

| | |
|---|---|
| ***E05B 17/20*** | (2006.01) |
| ***E05C 19/00*** | (2006.01) |
| ***E05B 65/06*** | (2006.01) |
| ***E05B 65/08*** | (2006.01) |
| ***E05C 3/16*** | (2006.01) |
| *E05B 65/10* | (2006.01) |
| *E05C 1/00* | (2006.01) |

(52) U.S. Cl.

CPC ..... *E05C 19/002* (2013.01); *E05B 65/1066* (2013.01); *E05C 2001/008* (2013.01); *Y10T 292/1021* (2015.04); *Y10T 292/1089* (2015.04)

(56) References Cited

U.S. PATENT DOCUMENTS 1,185,422 A 5/1916 Mammelli
1,231,069 A 6/1917 Schaffert
1,517,447 A * 12/1924 Merz ..... E05D 15/00 292/145
1,609,342 A 12/1926 Winters et al.
1,711,213 A * 4/1929 Smith ..... E05C 3/24 292/198
1,973,461 A 9/1934 Barringer
2,029,901 A 2/1936 Voight
2,108,965 A 2/1938 Gray
2,454,690 A * 11/1948 Dean ..... E05C 19/10 292/128
2,572,717 A 10/1951 Gersten
2,579,875 A 12/1951 Stanko
2,663,585 A * 12/1953 Tye ..... E05C 19/10 292/106
2,812,204 A 11/1957 Squire
2,834,066 A 5/1958 Lybarger
2,978,757 A 4/1961 Ammerman
3,002,592 A 10/1961 Quinn
3,019,493 A 2/1962 Walenga
3,159,093 A 12/1964 Rosenfeld
3,172,168 A 3/1965 Suska
3,222,098 A 12/1965 Hausfeld
3,596,954 A 8/1971 Hull et al.
3,634,962 A 1/1972 Peterson
3,841,516 A 10/1974 Marz
3,872,696 A 3/1975 Geringer
3,877,262 A 4/1975 Williams
3,877,282 A 4/1975 Pogonowski
3,924,884 A 12/1975 Christie
3,959,927 A 6/1976 Good
3,973,794 A 8/1976 Green
4,004,629 A 1/1977 Kelly
4,010,239 A 3/1977 Dor
4,036,517 A * 7/1977 Talmadge ..... E05C 3/24 292/216
4,045,065 A 8/1977 Johnson
4,056,276 A 11/1977 Jarvis
4,062,576 A 12/1977 Jennings et al.
4,106,239 A 8/1978 Bancroft et al.
4,110,867 A 9/1978 Gwozdz
4,126,965 A 11/1978 Hoffmann
4,133,142 A 1/1979 Dzus, Jr.
4,178,859 A 12/1979 Heinz
4,180,287 A 12/1979 Young
4,203,255 A 5/1980 MacDonald
4,216,986 A 8/1980 McNinch et al.
4,230,351 A 10/1980 Bisbing
4,300,795 A 11/1981 Jennings
4,367,610 A 1/1983 Goode
4,428,153 A 1/1984 Klinger et al.
4,441,277 A 4/1984 Naylor
4,534,587 A 8/1985 Fleming
4,610,472 A 9/1986 Billingsley
4,643,005 A 2/1987 Logas
4,765,662 A 8/1988 Suska
4,824,154 A 4/1989 Simpson
4,831,779 A 5/1989 Kehrli et al.
4,856,830 A 8/1989 Chateau
4,993,757 A * 2/1991 Corzine ..... E05B 47/0002 292/144
5,060,992 A * 10/1991 Anderson ..... E05C 3/044 292/207
5,137,327 A 8/1992 Edmonds et al.
5,172,520 A 12/1992 Hostetler et al.
5,188,404 A 2/1993 Orendorff
5,224,297 A 7/1993 Watkins
5,319,882 A 6/1994 Biebuyck
5,326,141 A 7/1994 Gorman
5,349,782 A 9/1994 Yulkowski
5,361,539 A 11/1994 Widener
5,403,047 A 4/1995 Walls
5,409,272 A 4/1995 McCormack
5,465,460 A 11/1995 Cantone
5,465,480 A 11/1995 Karl et al.
5,570,915 A 11/1996 Asadurian
5,660,021 A 8/1997 Wolgamot et al.
5,901,501 A 5/1999 Fountaine
5,927,773 A 7/1999 Larsen et al.
5,931,415 A 8/1999 Lingard et al.
6,185,871 B1 2/2001 Wang
6,286,274 B1 9/2001 McKann et al.
6,363,832 B1 4/2002 Francis
6,409,234 B1 6/2002 Larsen et al.
6,564,428 B2 5/2003 Richard et al.
7,000,550 B1 2/2006 Mandall
7,100,951 B2 * 9/2006 Jien ..... E05B 13/002 292/207
7,182,374 B2 2/2007 Figge et al.
7,578,531 B1 8/2009 Leontaridis
7,707,776 B2 5/2010 Weissofner et al.
8,038,184 B2 10/2011 Jyrki et al.
8,146,393 B2 4/2012 Katagiri et al.
8,424,931 B2 4/2013 Chang
8,468,746 B2 6/2013 Salerno
8,534,000 B1 9/2013 Fadlon
8,627,606 B2 1/2014 Salerno et al.
8,707,625 B2 4/2014 Raz et al.
8,813,427 B2 8/2014 Meeks
8,925,249 B2 1/2015 Speyer et al.
9,145,719 B2 9/2015 Hartford
9,598,894 B2 3/2017 Raz
9,670,691 B2 6/2017 Mansueto et al.
9,702,168 B2 7/2017 Jadallah et al.
9,970,214 B2 5/2018 Raz
9,988,830 B2 6/2018 Raz
10,138,654 B2 11/2018 Raz
10,221,595 B2 3/2019 Ward et al.
10,480,213 B2 11/2019 Raz
2002/0046501 A1 4/2002 Webb
2002/0095885 A1 7/2002 Sampson
2002/0145292 A1 10/2002 Furner
2002/0163208 A1 11/2002 Quigley et al.
2004/0222649 A1 11/2004 Ito et al.
2005/0001436 A1 1/2005 Ramsauer
2006/0021400 A1 2/2006 Jackson
2007/0113478 A1 5/2007 Chu et al.
2007/0290456 A1 12/2007 Speyer et al.
2008/0054123 A1 3/2008 French et al.
2008/0129054 A1 6/2008 Tremble et al.
2009/0289065 A1 11/2009 Sampson
2012/0204503 A1 8/2012 Helton
2013/0000205 A1 1/2013 Raz et al.
2014/0190098 A1 7/2014 Raz et al.
2014/0259946 A1 9/2014 Mansueto et al.
2015/0123411 A1 5/2015 Woo
2016/0001643 A1 1/2016 Ichikawa
2016/0032627 A1 2/2016 Seiki
2016/0076275 A1 3/2016 Uemura et al.
2016/0076280 A1 3/2016 Rudraraju et al.
2016/0083976 A1 3/2016 Rickenbaugh et al.
2017/0152676 A1 6/2017 Raz
2017/0204621 A1 7/2017 Procton et al.
2017/0254119 A1 9/2017 Raz
2017/0254125 A1 9/2017 Raz
2018/0209175 A1 7/2018 Raz

(56) References Cited

U.S. PATENT DOCUMENTS

| | | | |
|---|---|---|---|
| 2018/0252025 | A1 | 9/2018 | Raz |
| 2018/0266153 | A1 | 9/2018 | Marsh |
| 2019/0071895 | A1 | 3/2019 | Raz |

FOREIGN PATENT DOCUMENTS

| | | | |
|---|---|---|---|
| CA | 1029063 | | 4/1978 |
| CN | 107923197 | | 4/2018 |
| DE | 929592 | | 6/1955 |
| DE | 8900012 | | 3/1969 |
| DE | 2628036 | | 1/1977 |
| DE | 2652562 | | 6/1977 |
| DE | 2852670 | | 6/1980 |
| DE | 3447796 | | 7/1986 |
| DE | 8438238 | | 12/1987 |
| DE | 8900012 | | 3/1989 |
| DE | 29517077 | | 2/1997 |
| DE | 10117173 | | 10/2002 |
| DE | 10329560 | | 2/2004 |
| DE | 10322798 | | 12/2004 |
| DE | 102004054981 | | 5/2006 |
| EP | 0067075 | | 12/1982 |
| EP | 0094461 | | 11/1983 |
| EP | 0270437 | | 6/1988 |
| EP | 0811738 | | 12/1997 |
| EP | 1422368 | | 5/2004 |
| EP | 1574657 | | 9/2005 |
| EP | 1775403 | | 4/2007 |
| EP | 2726688 | | 5/2014 |
| EP | 3341542 | | 7/2018 |
| EP | 3347557 | | 7/2018 |
| FR | 469276 | | 7/1914 |
| FR | 2631068 | | 11/1989 |
| FR | 2844822 | | 3/2004 |
| FR | 2891295 | | 3/2007 |
| GB | 1399058 | | 6/1975 |
| GB | 2154639 | | 9/1985 |
| GB | 2195958 | | 4/1988 |
| GB | 2233701 | | 1/1991 |
| GB | 2250772 | | 6/1992 |
| GB | 2521932 | | 7/2015 |
| KR | 101444618 | B1 * | 9/2014 |
| WO | 2013001488 | | 1/2013 |
| WO | 2013018496 | | 3/2015 |
| WO | 2017033177 | | 3/2017 |
| WO | 2017042799 | | 3/2017 |
| WO | 2017090020 | | 6/2017 |
| WO | 2017149544 | | 9/2017 |
| WO | 2017149545 | | 9/2017 |

* cited by examiner

LATCH ARRANGEMENT HAVING A STOP LATCH

FIELD OF INVENTION

The presently disclosed subject matter relates to a latch arrangement having a stop latch, in general and in particular for a latch arrangement for fastening a panel of a door or a window to a frame element.

BACKGROUND

A latch arrangement for fastening a panel of a door or a window to a frame element is an arrangement which includes a locking element displaceable with respect to the panel between a locked position in which the locking element is engaged with the frame element and the panel precluding thereby the displacement of the panel away from the frame element. The locking element can be mounted on the frame element and displaceable towards and away from the panel so as to lock the panel to the frame element. Alternatively, the locking element can be mounted on the panel and can be displaceable towards and away from the frame element so as to lock the panel to the frame element.

U.S. Pat. No. 4,803,808 discloses a swivel fitting for an outwardly opening window, with a device for moving the casement frame between the closed position and the open position, for example in the form of a hand crank, with position-fixing arm driven by the crank and with an operating handle on one frame member of the stationary frame, in order to fix the casement frame in the closed position. At least one locking plate is included on the casement frame which co-operates with a locking element on a drive rod operable by the handle. When the window is in the closed position, a locking projection of the locking plate protrudes into a groove in the stationary frame so that the closing movement of the window may be supported relatively early by actuation of the handle and to ensure high security against break-in.

SUMMARY OF INVENTION

There is provided in accordance with an aspect of the presently disclosed subject matter a latch arrangement for fastening a panel of a door or a window to a frame element, the panel including a depression. The latch arrangement includes a locking element pivotally mounted on the frame element and displaceable between a locked position in which the locking element is engaged with the depression of the panel locking thereby the panel to the frame element, and an unlocked position in which the locking element is disengaged from the depression of the panel unlocking thereby the panel from the frame element, a stop latch selectively deployable to secure the locking element in the locked position, precluding thereby displacement of the locking element to the unlocked position; and an actuating mechanism configured to selectively pivot the locking element away from the depression to the unlocked position.

The actuating mechanism can be configured to selectively shift the stop latch such that the locking element can be unsecured by the stop latch allowing thereby the displacement of the locking element to the unlocked position.

The stop latch can be selectively displaced between a secured position in which the locking element can be secured in the locked position, and a released position in which the locking element is free to be displaced to the unlocked position and wherein the actuating mechanism includes an actuating member slidably mounted on the panel and configured to selectively slide towards the stop latch and to displace the stop latch to the released position.

The actuating mechanism includes a manually operated handle that can be mounted on the panel.

The actuating mechanism includes a rotating actuator configured to rotate while engaging at least a portion of the stop latch such that said stop latch can be disengaged from said locking element allowing thereby the displacement of said locking element to the unlocked position.

The locking element in said locked position can be extended at an oblique angle with respect to the panel such that a first end of the locking element can be configured to engage the depression while a second end of the locking element can be engaged with a portion of the frame element, and wherein in the locked position displacement of the panel towards an opening direction of the panel is opposed by compressive forces exerted on the locking element and on the portion of the frame element.

The stop latch can be mounted on the locking element and can be configured to selectively engage an abutment feature such that displacement of the locking element to the unlocked position is precluded.

The stop latch can be slidably mounted on the locking element and can be configured to slide between a secured position in which at least one portion thereof is engaged with the abutment feature and a released position in which said at least one portion is retracted away from said abutment feature such that said locking element is free to be displaced to said unlocked position. The abutment feature can be defined on the panel. The abutment feature can be a recess defined inside the depression or the abutment feature can be defined on the frame element.

The stop latch can be pivotally mounted on the locking element and can be configured to pivot between a secured position in which the locking element is secured in the locked position and a released position in which the locking element is free to be displaced to the unlocked position. The latch arrangement can further include an abutment feature defined on the frame element. The latch can further include an actuating mechanism mounted on the panel and configured to selectively actuate the locking element, wherein the actuating mechanism includes a catch member and wherein in the secured position the stop latch is engaged with the catch member.

The locking element can be pivotally mounted on the frame element and can be configured to pivot about a first axis and wherein the stop latch includes a catch member and is pivotally mounted on the frame element and is configured to pivot about a second axis, different than the first axis, and wherein the stop latch is configured to selectively pivot between a secured position in which the catch member is engaged with a corresponding portion of the locking element, and a released position in which the catch member is disengaged from the corresponding portion such that the locking element is free to be displaced to the unlocked position.

The locking element includes a at least two projecting surfaces wherein at least one of the two projecting surfaces can be configured to engage the depression precluding thereby the opening of the panel, while the other one of the two projecting surfaces is disengaged from the depression.

The locking element can be an elongated member configured such that in the locked position a first end thereof is engaged with a depression of a first panel while a second end of the locking element is engaged with a depression of a second panel, locking thereby the first panel and the second panel to the frame element. There is provided in accordance with another aspect of the invention a latch arrangement for fastening a panel of a door or a window to a frame element, the panel including a depression. The latch arrangement includes a locking element pivotally mounted on the frame element and displaceable between a locked position in which the locking element is engaged with the depression of the panel locking thereby the panel to the frame element, and an unlocked position in which the locking element is disengaged from the depression of the panel unlocking thereby the panel from the frame element wherein the locking element includes an anchor configured to engage a catch portion on the panel, wherein the engagement of the anchor and the catch portion is configured to limit a lateral displacement of the panel and to preclude thereby a disengagement of the depression form the locking element.

The terms "shift" and "displace" as used herein the specification and claims refers generically to any mechanical displacement of various elements including but not limited to linear displacement, pivot movement, rotational movement etc. The term "panel" is used to refer to the element deployed across at least part of the opening in the closed state. The panels and corresponding closures may be doors, windows or any other type of opening which is selectively closed (or partially closed) by a hinged or a sliding panel.

The phrase "mounted on" as used herein refers to a first element affixed to a second element in any disposition between the two elements including the first element disposed on the second element, inside the second element, affixed to any outer surface of the second element, etc.

The phrase "defined on" as used herein refers to a feature or an element provided on a member in any manner, including integrally formed with the member, attached to the member etc.

The term "door" as used herein the specification and claims refers generically to any moving panel configured to selectively block off and allow access through an opening to a structure, such as a building or vehicle, an entrance to a confined area, or between two confined areas including hinged door, sliding door, a window of any type, as well as a hood and a trunk for covering vehicles or portions thereof, etc.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

The invention relates to a latch arrangement for fastening a panel, such as a door or a window, to a frame element around an opening. The latch arrangements includes a locking element, such as a bolt or latch, displaceably mounted relative to the frame element for selectively engaging a corresponding depression in the panel of the door or the window. According to one aspect, the present invention provides a deadlock feature, such as stop latch configured to secure the locking element and to maintain the engagement thereof with the depression. The stop latch is preferably configured such that it is not accessible from the gap between the panel and the frame element, so that an undesirable displacement of the stop latch is precluded.

Further, in certain preferred embodiments, the latch arrangement includes a manually operable handle mounted on the door or the window panel which interacts, by means of an actuating mechanism, with the locking element on the frame element and the stop latch.

The actuating mechanism is configured to selectively displace the stop latch such that the locking element is no longer secured and can be displaced out of engagement with the depression defined on the door or the window panel. Thus opening the panel of the door or the window, can be carried out by a user operating the handle on the door without the user having to interact with a mechanism on the frame.

Further, according to an example, if the locking element is provided with a deadlock feature, the actuating mechanism is preferably configured such that motion of the handle performs sequentially release of the deadlock and then displacement of the locking element out of engagement.

FIGS. 1A to 1F show a hinged door including a door panel 10, a frame element 12, and a latch arrangement 20 for fastening the panel 10 to the frame element 12. Although the description here is directed by way of a non-limiting example to a door, it will be appreciated that the latch arrangement can be equally implemented in the context of a window or any other situation where a displaceable panel is selectively locked in place across an opening.

Figure 1B:
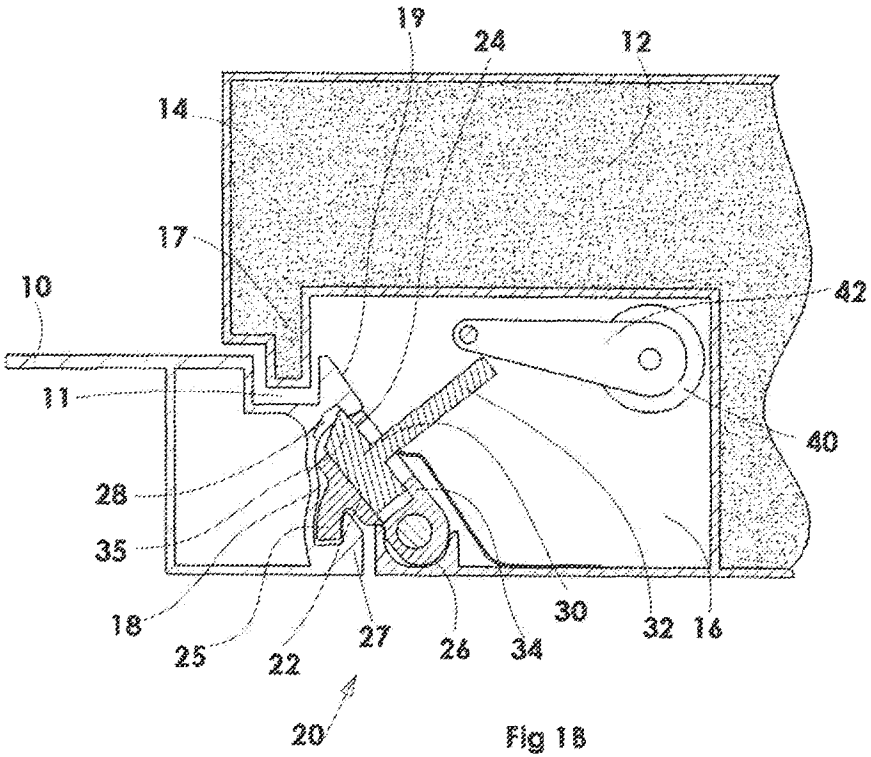
FIGS. 1B-1F are a sequence of top sectional views of the panel of FIG. 1A showing states of a latch arrangement including a stop latch during unlocking, illustrating the arrangement, respectively, in a fully locked state, a locked state with the stop latch disengaged, a transition state, a fully unlocked state, and in a state of rest ready for closure of panel.
Figure 1A:
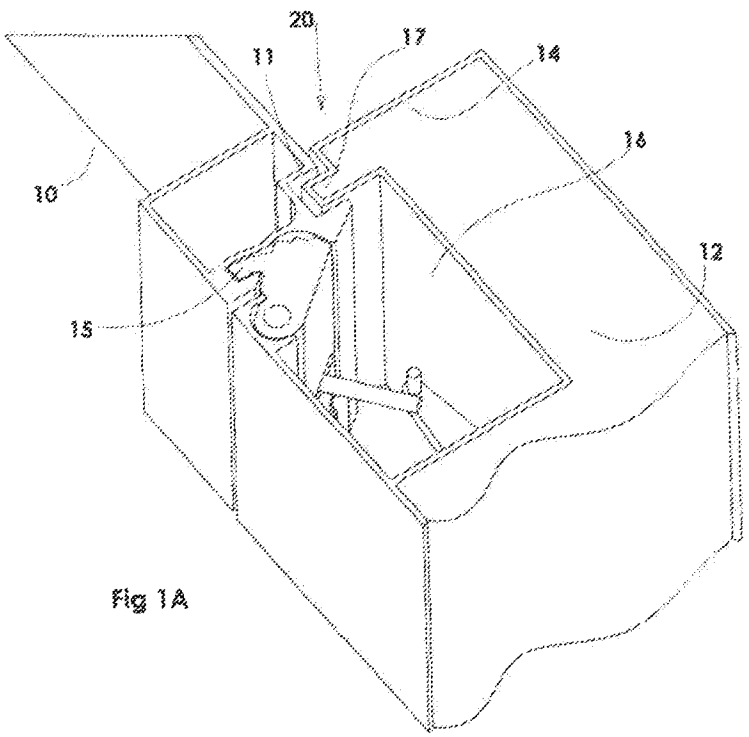
FIG. 1A is a top cut-away perspective view of a panel having latch arrangement in accordance with an example of the presently disclosed subject matter.

As shown in FIGS. 1A and 1B, the door panel 10 is configured to abut, in the closed state thereof, against a shoulder portion 14 defined by the frame element 12. In the preferred but non-limiting example illustrated here, the shoulder portion 14 includes a protrusion 17 configured to engage a corresponding recess 11 formed at the edge of the panel 10, when the latter is at the closed state of the panel 10, the purpose of which will become apparent hereinafter. The frame element 12 according to the illustrated example includes an enclosure 16 for holding therein the latch arrangement 20, such that the latch arrangement can interact with the frame facing portion 15 of the door panel 10 when the latter abuts the shoulder portion 14 or is in close proximity thereto.

Figure 1D:
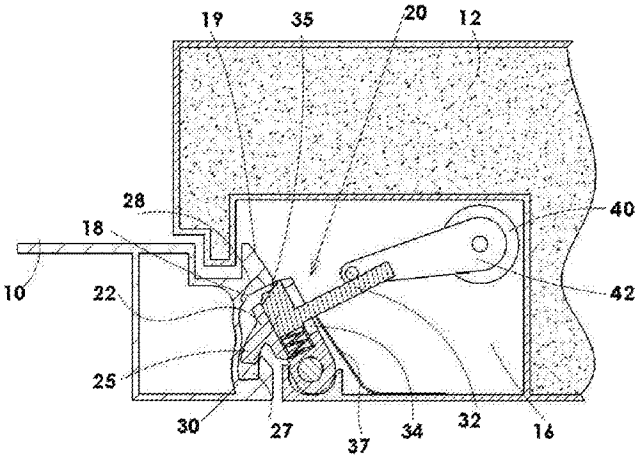
Figure 1F:
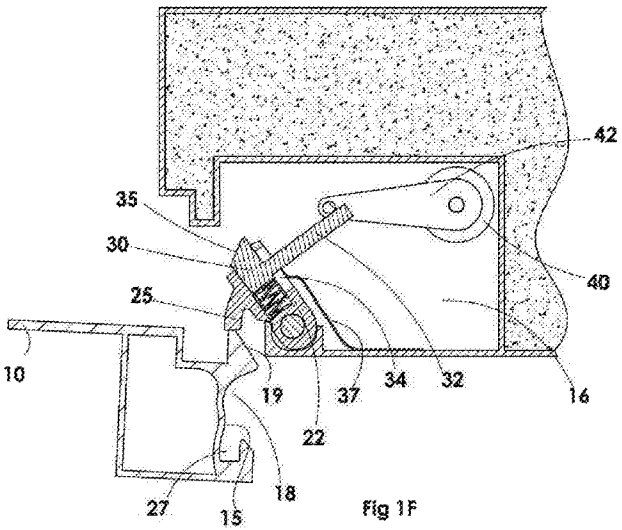
Figure 1C:
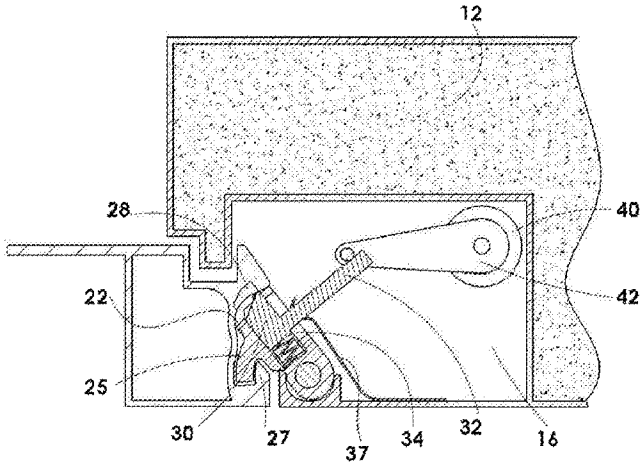
Figure 1E:
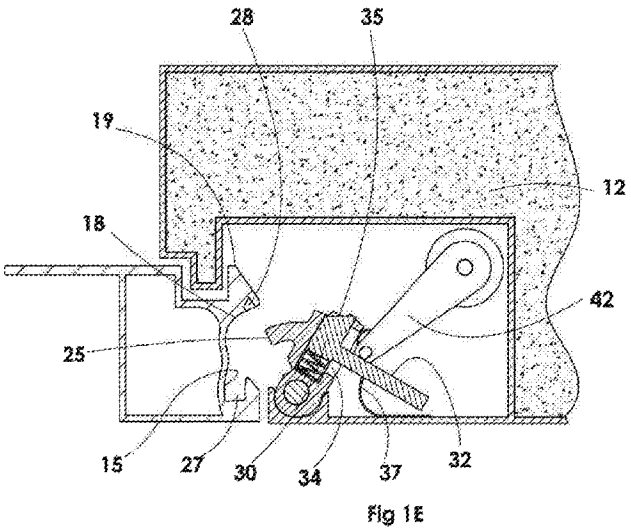

The latch arrangement 20, according to the present example, includes a locking element 22 pivotally mounted on the frame element 12 and displaceable between a locked position, as shown in FIGS. 1B to 1D, and an unlocked position shown in FIG. 1E. It is a particular feature of an aspect of the present invention that the present invention provides solutions for implementing a stop latch in the context of such a locking element pivotally mounted on the frame element, thereby providing "deadlock" functionality to locking elements of this type.

The locking element 22, can include a first end 24 configured to engage a depression 18 defined on the frame facing portion 15 of the door panel 10, and a second end 26 affixed to the frame element 12. In order to better support the locking element 22, the second end 26 preferably has a rounded shape, and is mounted on a corresponding seat defined on the frame element 12. The matching of the external shape of end 26 to a corresponding seat in the frame element provides support in the case of sudden or extreme load such as attempted forced entry or a blast, where the pivot axis itself would not be strong enough.

According to an example, as shown in FIG. 1B, in the locked position, the locking element 22 is pivoted towards the panel 10 and outwards from the enclosure 16 and is disposed at an oblique angle with respect to the panel 10. The depression 18 on the frame facing portion 15, according to this example, is defined as a sloped cutaway which is cut at an angle with respect to the frame facing portion 15 so as to achieve geometrical locking with locking element 22 when engaged. The angle of the sloped cutaway depression 18 corresponds to the angle of the first end 24 of the locking element 22 with respect to the panel 10, when the locking element 22 is in the locked position. This way, when the door panel 10 is in the closed state thereof and the locking element 22 is pivoted to the locked position, the first end 24 of the locking element 22 is engaged with the cutaway depression 18, locking thereby the panel 10 to the frame element 12.

When the locking element 22 is pivoted away from the cutaway depression 18, the first end 24 of the locking element 22 is disengaged from the cutaway depression 18 on the panel 10, such that the latter is unlocked and can freely rotate to the opened state thereof, as shown in FIG. 1E. Once the panel 10 is clear of the frame, locking element 22 typically returns to a resting position corresponding to its locked position (FIG. 1F), for example, under the bias of a leaf spring 37.

It is appreciated that the locking element 22 (and the analogous locking elements of other exemplary embodiments described below) can extend along a significant proportion of a length of the frame element, such as in excess of 10%, and more preferably in excess of 25% of the length of the frame element. In some particularly preferred implementations, locking element 22 extends along the entire or the majority of the length of the frame element, such that in the locked position it is engaged with the cutaway depression 18 which can also be defined along the entire or the majority of the length of the frame facing portion 15. Use of an extended locking configuration extending along a major part of a dimension of the frame provides highly robust locking capable of withstanding large applied loads without compromising the structural integrity of the components.

The locking element 22 according to the illustrated example includes an anchor 25 which is configured to engage a catch portion 27 formed along the frame facing portion 15 of the panel 10, when the panel 10 is in the closed state thereof, and the locking element 22 is in the locked position. The anchor 25 and the catch portion 27 are configured to preclude lateral displacement of the frame facing portion 15, such that the depression 18 is disengaged from the first end 24 of the locking element 22. That is to say, while the first end 24 of the locking element 22 is configured to preclude pivoting of the panel 10 to the opened state thereof, the anchor 25 is configured to preclude lateral displacement of the panel 10, such that the depression 18 is sidewardly displaced away from the first end 24 of the locking element 22.

It is appreciated that such sideward displacement can occur for example when panel 10 is pressed at the middle thereof between the two side frames of the door or the window. I.e., if the panel 10 is convexly or concavely distorted the first end 24 of the locking element 22 may be slightly shifted away from the frame element 12 such that that the depression 18 is no longer engaged with the locking element 22. Accordingly, the anchor 25 and the catch portion 27 are configured to preclude such displacement, so as to maintain the engagement between the depression 18 and the locking element 22.

The latch arrangement 20 further includes a stop latch 30 selectively deployable to secure the locking element 22 in the locked position, precluding thereby displacement of the locking element 22 to the unlocked position. The stop latch 30 according to the present example is slidably mounted inside the locking element 22 and is configured to selectively slide between a secured position in which at least an engaging portion 35 thereof protrudes from the first end 24 of the locking element 22, and a released position in which the stop latch 30 is retracted inside the locking element 22.

According to the present example, in secured position, the engaging portion 35 of the stop latch 30 is engaged with an abutment feature in a form of a recess 28 defined on the frame facing portion 15 of the panel 10. In the released position, on the other hand, the engaging portion 35 is retracted away from the recess 28, such that the locking element is free to pivot to the unlocked position thereof away from the depression 18.

Further, as indicated above, the recess 28 according to the illustrated example is formed inside the depression 18, such that the engaging portion 35 can protrude from the first end 24 of the locking element 22, to engage the recess 28 while the first end 24 of the locking element 22 is engaged with the depression 18.

Although, as mentioned above, locking element 22 may advantageously be implemented as an elongated element extending along a significant proportion of a length of the frame element, it is typically sufficient to employ a stop latch 30 that achieves localized locking of locking element 22 at one location. Stop latch 30 itself is not typically subject to large loads, and serves only to prevent unauthorized displacement of locking element 22 out of its locked position.

The stop latch 30 according to an example can be biased to the secured position thereof, i.e., the engaging portion 35 protrudes from the first end 24.

The latch arrangement 20 further includes an actuating mechanism 40 configured for displacing the locking element 22 between the locked position and the unlocked position. According to the illustrated example, displacement of the locking element 22 by the actuating mechanism 40 is carried out by engagement of the actuating mechanism 40 with a rod 32 protruding from the stop latch 30, such that the stop latch 30 is shifted to the released position allowing thereby the displacement of the locking element 22 to the unlocked position.

The actuating mechanism 40 includes a rotating actuator 42 mounted inside the enclosure 16. The rotating actuator 42 is configured to selectively rotate in a first and a second direction in a motion about an axis parallel to an axis of the pivoting motion of the locking element 22, while engaging the rod 32 of the stop latch 30. As explained hereinabove, the stop latch 30 is slidably mounted inside the locking element 22, thus the rod 32 according to the present example protrudes out of the locking element 22 via an elongated aperture 34. The elongated aperture 34 is so configured such that rod 32 can be laterally displaced, sliding therewith the stop latch 30 inside the locking element 22.

As shown in FIGS. 1C to 1E, when the rotating actuator 42 is rotated in a first direction, the rotational motion thereof urges the rod 32 of the stop latch 30 to slide sidewardly until the engaging portion 35 of the stop latch 30 is retracted away from the recess 28 to the released position thereof.

The sliding of the stop latch 30 inside the locking element 22 to the released position is limited by the inner structure of the locking element 22, thus further rotation of the rotating actuator 42 in the first direction urges the locking element 22 to pivot away from the depression 18 to the unlocked position thereof, as shown in FIGS. 1D and 1E.

With reference to FIG. 1E, as the locking element 22 is pivoted away from the depression 18 and completely disengaged therefrom, the door panel 10 can be rotated to the opened state thereof.

The rotating actuator 42 can be rotated in a second direction or continue in the first direction, such that the rod 32 of the stop latch 30 slides under the influence of a biasing spring (not shown) back to the secured position and the locking element 22 pivots under the influence of leaf spring 37 back to the locked position. It is appreciated that the sliding of the stop latch 30 and the locking element 22 back to the secured and locked position, respectively, can be carried out by a return mechanism, such as a spring 39, etc. Accordingly, the rotating actuator 42 is configured to oppose the force of such return mechanism when the rotating actuator 42 is rotated in the first direction. When the rotating actuator 42 is rotated in the second direction however, the stop latch 30 and the locking element 22 are preferably urged back to the secured and locked position, respectively, by the forces of the return mechanism.

As shown in FIG. 1F, when the panel 10 is in the open state, and the locking element 22 is pivoted to the locked position thereof, closing of the panel 10 such that it abuts against a shoulder portion 14 on the frame element 12 might be blocked by the locking element 22. Thus the frame facing portion 15 of the panel 10 can include a sloped portion 19 configured to interact with the anchor 25 of the locking element 22. That is to say, the sloping direction of the sloped portion 19 is configured such that when the panel 10 is pivoted from the opened state thereof to the closed states thereof the sloped portion 19 of the frame facing portion 15 engages the anchor 25. This way, when the panel 10 is pivoted towards the shoulder portion 14 the displacement thereof is not blocked by the locking element 22 even when the latter is in the locked position thereof. Rather, the sloped portion 19 engages the anchor 25 of the locking element 22 and gradually pivots the locking element 22 to the locked position thereof, such that the frame facing portion 15 can abut the shoulder portion 14.

Turning now to FIGS. 2A to 2D, according to an example the locking element 22 can be configured to allow gradual fastening of the panel 10 to the locking element 22. That is to say, when the panel 10 is rotated to the closed state thereof and the edge of the panel 10 is in close proximity to the shoulder portion 14 it is desired that the panel 10 is maintained in this position and does not rotates back to the opened state. This way, the panel 10 can first be rotated such that it is almost closed, following which the panel 10 can be pushed such that it is locked by the locking element 22, facilitating thereby the closing of the panel.

Figure 2B:
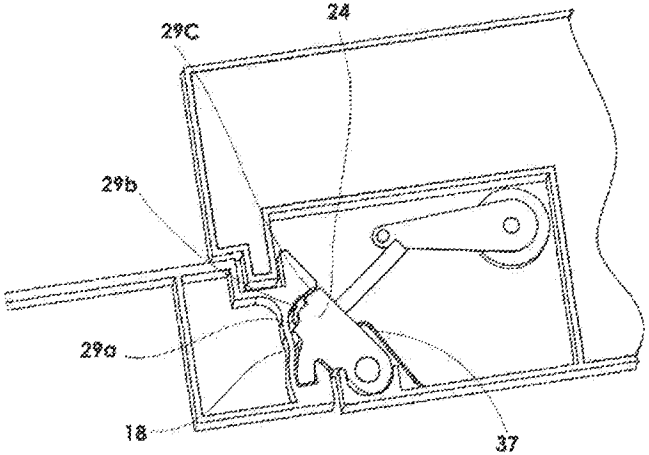
FIGS. 2A-2D are a sequence of top sectional views of the panel of FIG. 1A showing states of a latch arrangement including a stop latch during closing of the panel, illustrating the arrangement, respectively, in a unlocked position, locked position and an intermediate position.

For example, the first end 24 of the locking element 22 can include two or more projecting surfaces each protruding at a different distance from the first end 24. As shown in FIG. 2B, in the present example the first end 24 of the locking element 22 includes three projecting surfaces 29*a*, 29*b* and 29*c* defined such that the first projecting surface 29*a* has the smallest projection and the third projection 29*c* has the largest projection. Accordingly, the three projecting surfaces 29*a*. 29*b* and 29*c* form together a stairs-like surface.

The first projecting surface 29*a* is defined on the first end 24 of the locking element 22 such that when the locking element 22 is pivoted towards the depression 18, the first projecting surface 29*a* engages the depression 18 first, as the locking element 22 pivots slightly more towards the depression 18 the second projecting surface 29*b* engages the depression, and finally, as the locking element 22 completes its pivoting motion towards the depression 18 the third projecting surface 29*c* engages the depression 18.

Figure 2D:
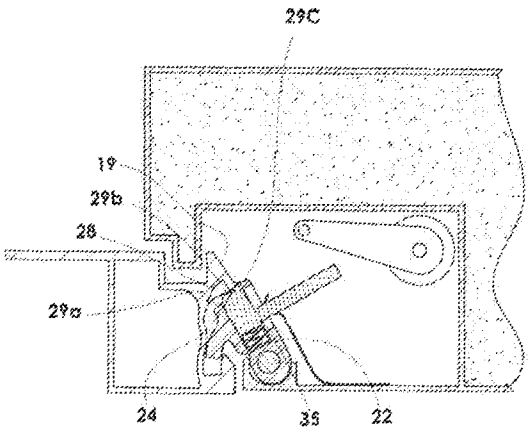
Figure 2A:
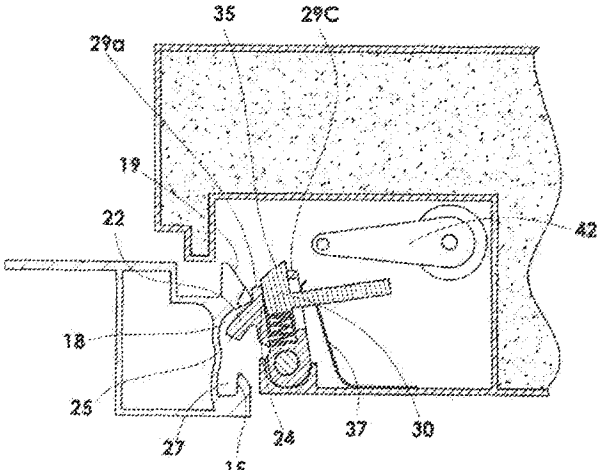
Figure 2C:
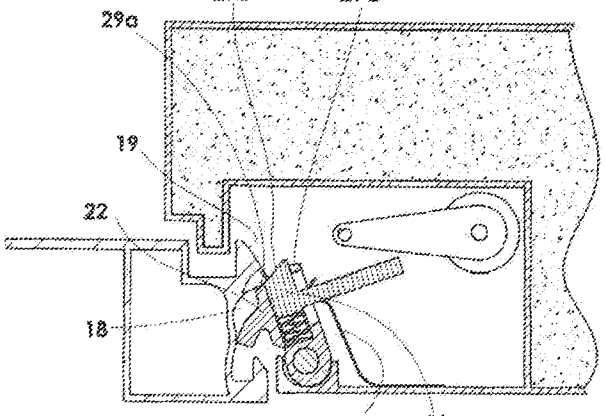

This way, when the door panel 10 is rotated to the closed state thereof, and the depression 18 is in close proximity with the locking element 22 the latter can be pivoted towards the depression 18, at this intermediate position, as illustrated in FIG. 2C, the edge of the depression 18 engages the first projecting surface 29*a* such that the door cannot be rotated back the opened state without pivoting the locking element 22 away from the depression 18.

As shown in FIG. 2D, as the door panel 10 is pushed further towards the shoulder portion 14, the locking element 22 can pivot further towards the depression 18, such that the edge of the depression 18 engages the second projecting surface 29*b*. Finally, as the locking element 22 is it at the locked position thereof, as shown in FIG. 2B, the edge of the depression 18 engages the third projecting surface 29*c*.

It is appreciated that the stop latch 30 can be configured to slide to the secured position. i.e. the engaging portion 35 project out of the first end 24 of the locking element 22 to engage the recess 28, only when the depression 18 engages the second projecting surface 29*b* and the locking element 22 is at the locked position.

It will be appreciated by those skilled in the art that although the present example is a hinged door panel, a similar latch arrangement can be used for a sliding door panel.

Turning now to FIGS. 3A to 3E, a latch arrangement 51 can be implemented for fastening a panel 50 of a panic door to a frame element 52. As in the previous example, the panel 50 is a panel of a hinged door and is configured to abut, in the closed state thereof, against a shoulder portion 54 defined on the frame element 52 which includes a enclosure 55 for holding therein the latch arrangement 51. In addition the panel 50 includes a handle pivotally mounted on the panel 50, here illustrated as a panic bar 64 horizontally extending along the panel 50.

The panic door can be configured for an outdoor opening direction, such that pushing of the panic bar 64 in an opening direction of the door initiates the opening of the panel 50, as explained hereinafter. The design shown herein has been found to provide a unique combination of features. On one hand, a simple mechanical arrangement (detailed below) allows reliable instant release of the locking mechanism on application of force to a panic bar on the inside surface of the panel, thereby satisfying requirements for emergency exit provisions. At the same time, the pivotally mounted locking element extending along a relatively large extent of the length of the frame has been found to provide a degree of mechanical strength against pressure blasts or forced entry which cannot typically be achieved with other emergency exit door structures. These factors together with the implementation of the lock mechanism in an enclosure within the door frame, rendering the mechanism resistant to tampering from both within and without, leads to a highly advantageous structure with a wide range of domestic, commercial and industrial applications.

Figure 3A:
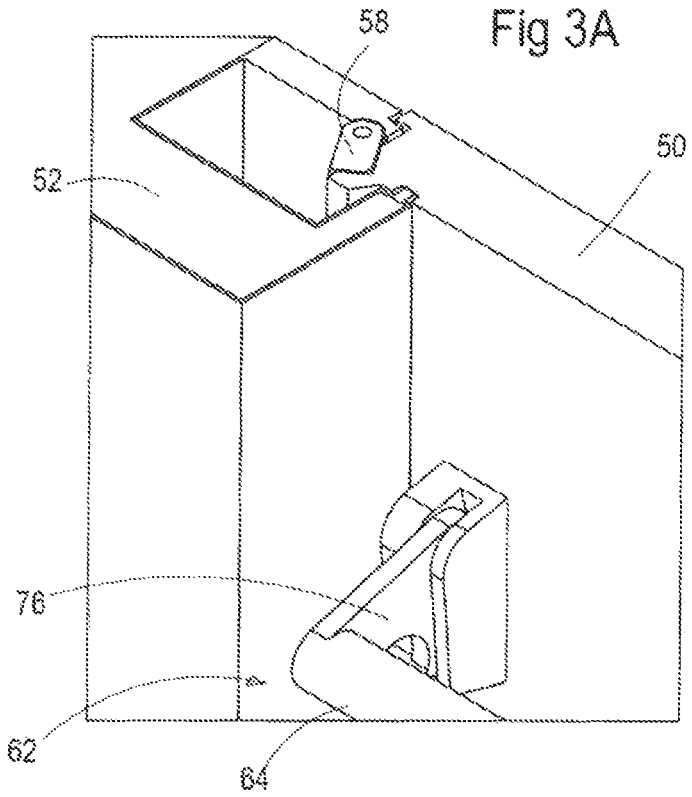
FIG. 3A is a perspective view of a panel having latch arrangement in accordance with another example of the presently disclosed subject matter.
Figure 3B:
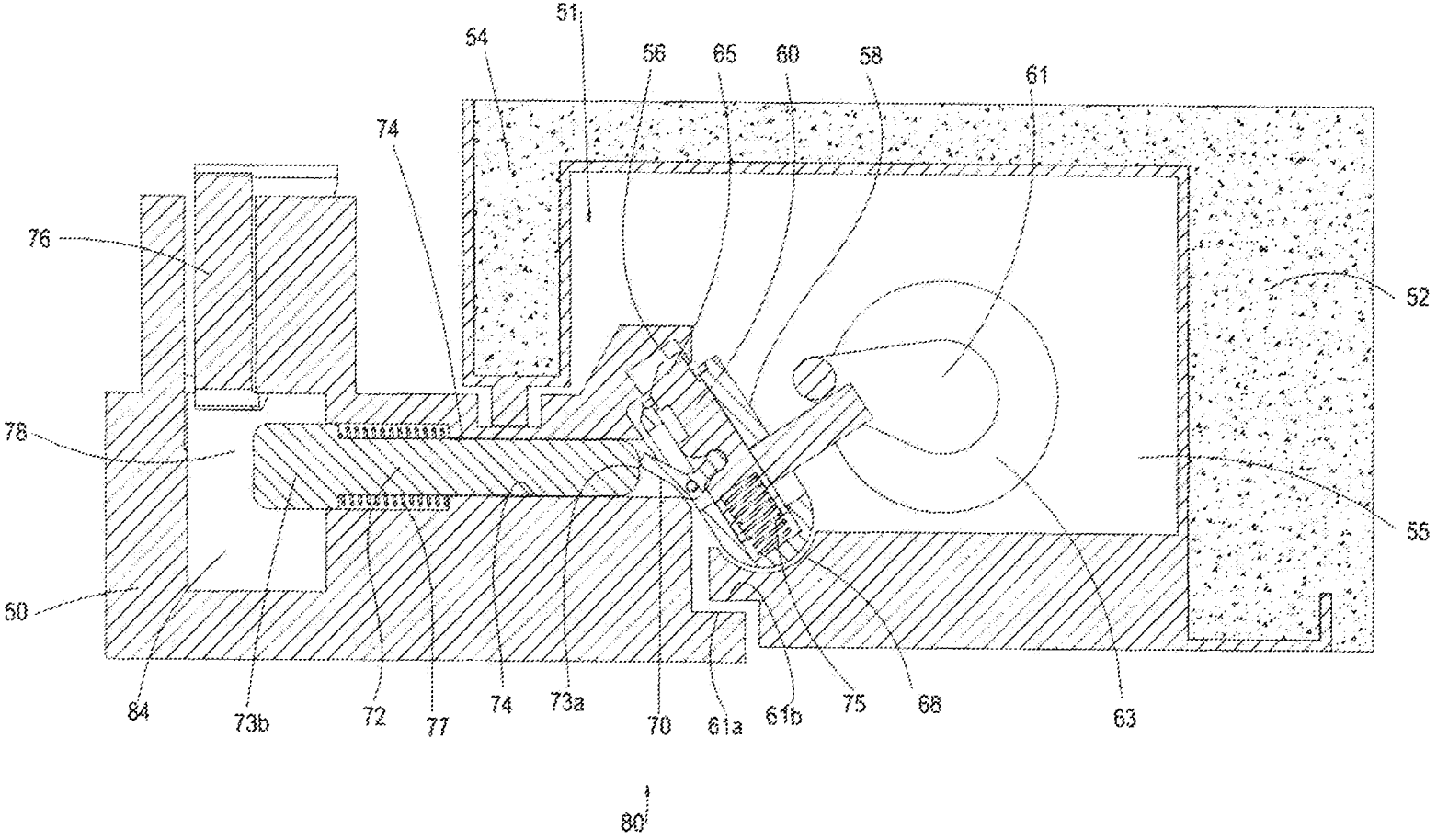
FIGS. 3B-3E are a sequence of top sectional views of the panel of FIG. 3A showing states of a latch arrangement including a stop latch during unlocking, illustrating the arrangement, respectively, in a fully locked state, a locked state with the stop latch disengaged, a fully unlocked state, and in a state of rest ready for closure of panel.
Figure 3C:
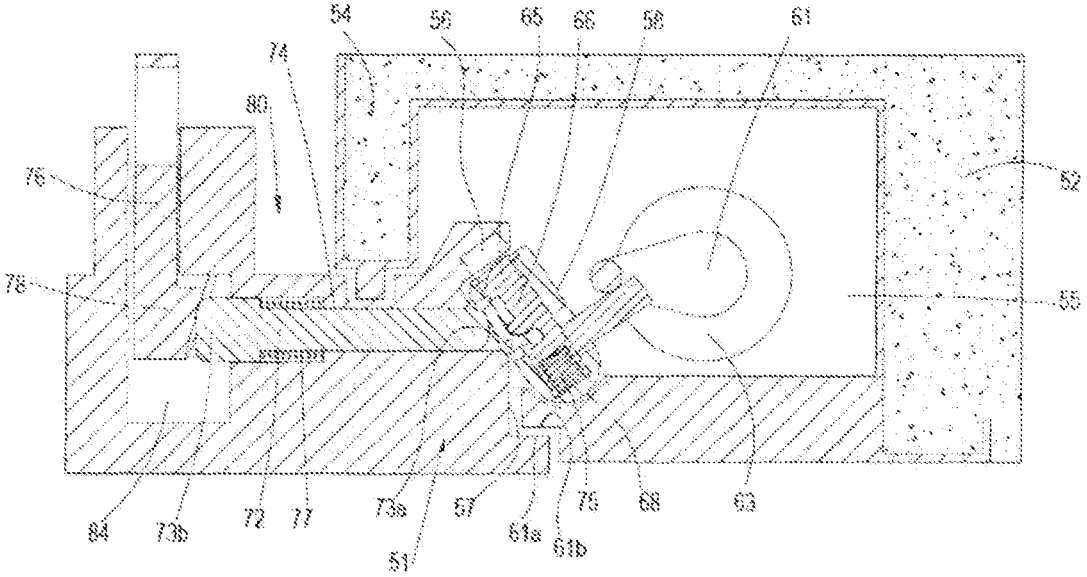
Figure 3D:
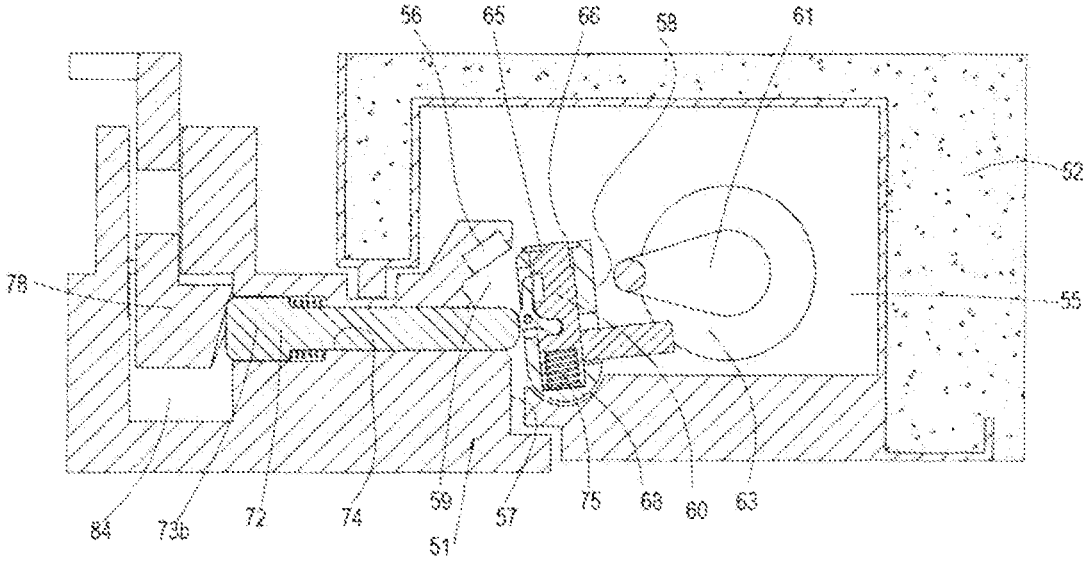
Figure 3E:
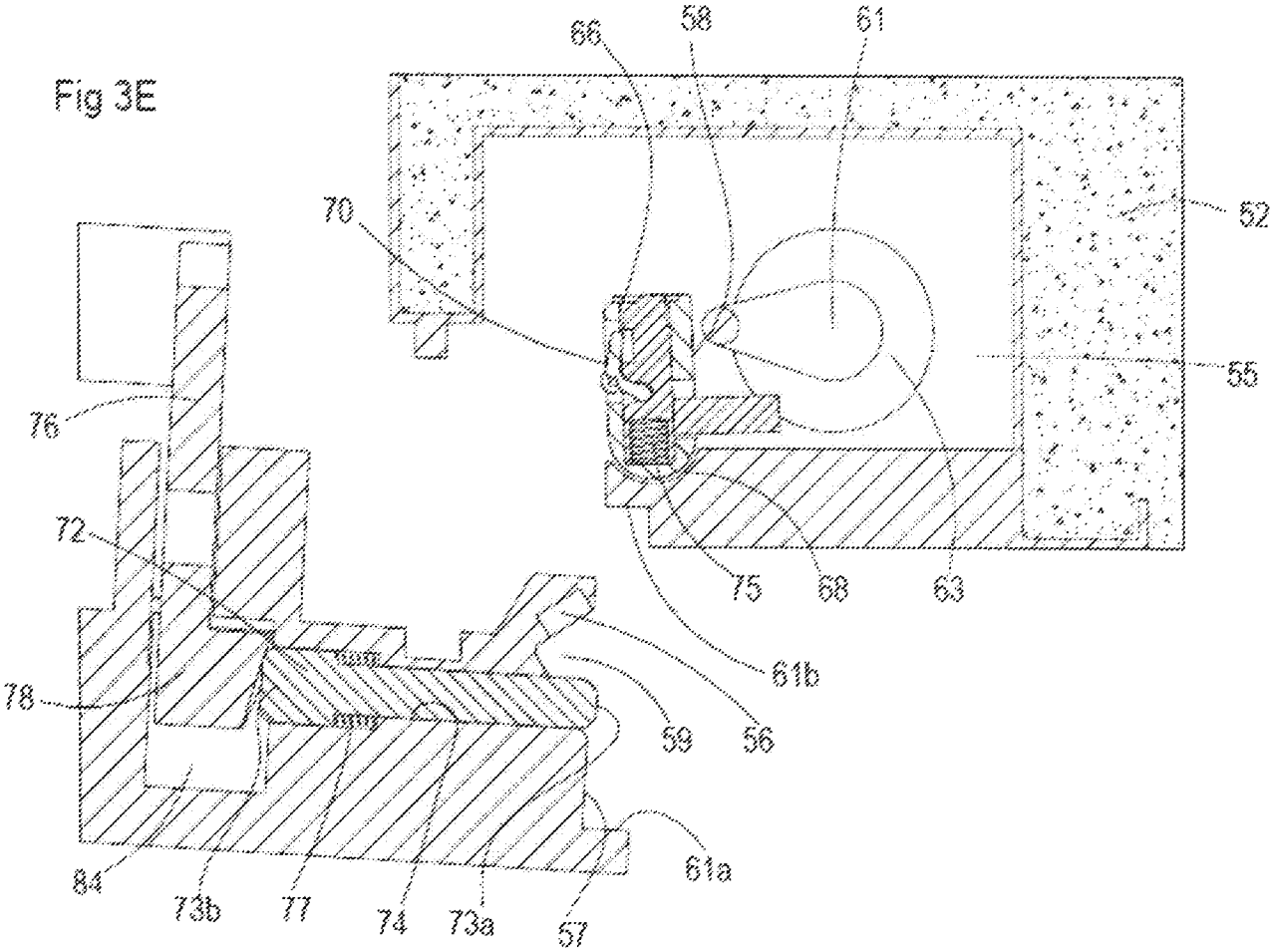

As in the previous example, the latch arrangement 51 includes a locking element 58 pivotally mounted on the frame element 52 and displaceable between a locked position, as shown in FIG. 3B, and an unlocked position shown in FIGS. 3D, and 3E. In addition, as in the previous example, the latch arrangement 51 includes a stop latch 60 selectively deployable to secure the locking element 58 in the locked position.

Further, as in the previous example the stop latch 60 is slidably mounted inside the locking element 58 and is configured to slide between a secured position in which at least one portion of the stop latch 60 is engaged with an abutment feature in a form of a recess 56, and a released position in which at least one portion of the stop latch 60 is retracted away from the recess 56. Further, according to the present example the abutment feature i.e. the recess 56 is defined on the panel 50.

According to the present example however, the latch arrangement 51 includes an actuating mechanism which can be manually operated by the handle 62. The present example further provides a rotating actuator 63 which is substantially the same as the rotating actuator 42 of the previous example.

The following detailed explanation is made with reference to FIGS. 3A to 3E. The locking element 58 includes a first end 66 configured to engage a depression 59 defined on the frame facing portion 57 of the door panel 50, and a second end 68 affixed to the frame element 52. As shown in FIG. 3B, in the locked position, the locking element 58 is pivoted towards the panel 50 and is disposed at an oblique angle with respect to the panel 50. This way, in the locked position the first end 66 of the locking element 58 is engaged with the cutaway depression 59, locking thereby the panel 50 to the frame element 52, and in the unlocked position the locking element 58 is pivoted away from the cutaway depression 59, such that the panel 50 is unlocked and can freely rotate to the opened state thereof, as shown in FIG. 3E.

According to an example the panel 50 includes a step 61*a* protruding from the frame facing portion 57 and configured to engage in a close state of the panel 50 a corresponding step 61*b* on the frame element 52. The step 61*a* is configured to cover the gap between the panel 50 and the frame element 52 in the closed state of the panel 50 such that the locking element 58 is not accessible from outside the panel 50 precluding an undesirable "lock picking".

As indicated above, the stop latch 60 according to the present example is slidably mounted inside the locking element 58 and is configured to selectively slide between a secured position in which at least an engaging portion 65 thereof protrudes from the first end 66 of the locking element 58, and a released position in which the stop latch 60 is retracted inside the locking element 58.

The stop latch 60 can be spring biased by a spring member 75 mounted inside the locking element 58, and is configured to urge the stop latch 60 to the secured position. i.e. the engaging portion 65 protrudes from the first end 66.

Further, as indicated above, the recess 56 according to the present example is configured as a recess formed inside the cutaway depression 59, and configured to engage with the engaging portion 65 of the stop latch 60.

Thus, when the door panel 50 is at the closed state thereof, and the locking element 58 can be pivoted to the locked position in which the first end 66 thereof is engaged with the cutaway depression 59 on the door panel 50. At this position, the stop latch 60 can be shifted to the secured position thereof, in which the engaging portion 65 protrudes from the first end 66, such that it engages the recess 56 formed inside the cutaway depression 59 precluding thereby the pivoting of the locking element 58 away from the depression 59 to the unlocked position.

The locking element 58 further includes a pivot arm 70 pivotally mounted thereon and being coupled to the stop latch 60, such that when the pivot arm 70 is pivoted towards the locking element 58, the stop latch 60 is urged to slide towards the inside the locking element 58 to the released position, the purpose of the pivot arm 70 is explained herein below.

As indicate above the latch arrangement 51 further includes a rotating actuator 63 which is substantially the same as the rotating actuator 42 of the previous example.

According to the illustrated example, the latch arrangement 51 further includes an actuating mechanism 80 configured for manual actuation of the latch arrangement 51. The actuating mechanism 80 includes an actuating member, here illustrated as an actuating pin 72 slidably disposed inside a groove 74 defined the panel 50 and having a first end terminating at the frame facing portion 57 of the door panel 50, and a second end terminating at a hollow portion 84 defined inside the panel 50. The groove 74 according to the illustrated example is so defined such that, when the panel 50 is in the closed state thereof, the groove 74 coaxially disposed with the pivot arm 70 of locking element 58.

The actuating pin 72 is thus configured to slide inside the groove 74 between the first and second ends of the groove 74, towards and away from the outer surface of the frame facing portion 57, such that the first end 73*a* thereof can selectively engage the pivot arm 70. As shown in FIG. 3B, the actuating pin 72 is disposed such that the second end 73*b* thereof is disposed inside the hollow portion 84, the purpose of which is explained hereinafter.

This way, as shown in FIG. 3C, when the actuating pin 72 is slid forwards and is engaged with the pivot arm 70 the latter pivots and causes the stop latch 60 to slide towards the inside the locking element 58 to the released position thereof, as shown in FIG. 3D The actuating pin 72 can be biased by a spring 77, such that is normally urged away from the outer surface of the frame facing portion 57. At this position, the pivot arm 70 is pivoted towards the first end of the groove 74.

According to an example, the actuating mechanism 80 can be manually operated by the handle 62 which, as noted above, includes a panic bar 64 pivotally mounted on the panel 50. The handle 62 can be displaceable between a first position in which the locking element 58 is urged away from the depression 59 and a second position in which the locking element 58 is free to engage the depression 59.

For example, the handle 62 can include a pivoting mount 76, on which the panic bar 64 is mounted. The pivoting mount 76 is pivotally mounted on the door panel 50 and includes a sloped member 78 configured to pivot in and out of a hollow portion 84 formed inside the panel 50. The hollow portion 84 is defined such that the second end of the groove 74 is accessible through the hollow portion 84, and the second end 73*b* of the actuating pin 72 protrudes inside the hollow portion 84.

The sloped member 78 of the pivoting mount 76 includes a portion having varying thickness so defined thereon such that when the sloped member 78 is pivoted inside the hollow portion 84 the sloped portion faces the second end of the groove 74 and engages the second end 73*b* of the actuating pin 72, which as indicated above is disposed in the hollow portion 84.

This way, when the panic bar 64 is pushed to the first position thereof, the pivoting mount 76 is pivoted and the sloped member 78 slides inside the hollow portion 84 such that the sloped member 78 engages the end of the actuating pin 72.

As a result, the sloped member 78 selectively urges the actuating pin 72 to slide inside the groove 74 towards the frame facing portion 57 pushing thereby the pivot arm 70 to pivot and displace the stop latch 60 to the release position. Further pushing of the panic bar 64 causes the sloped member 78 to further pivot into the hollow portion 84 and the actuating pin 72 to further slide inside the groove 74. At this position the further displacement of the pivot arm 70 in limited by the locking element 58, thus further displacement of the pivot arm 70 by the actuating pin 72 causes the locking element 58 to pivot away from the cutaway depression 59.

When the panic bar 64 is released to the second position of the handle, the spring 77 of the actuating pin 72 biases the actuating pin 72 such that it is retracted back toward the hollow portion 84, and the allowing the pivot arm 70 to pivot back and displace the stop latch 60 to the secured position in which the engaging portion 65 of the stop latch 60 engages the recess 56 formed inside the cutaway depression 59 precluding thereby the pivoting of the locking element 58 away from the depression 59 to the unlocked position.

A panic door of this type may be implemented as an exclusively mechanical door openable only from inside the building or other structure in which it is deployed. Alternatively, a supplementary release mechanism, such as the actuating mechanism 40 described above or a mechanical key-operated mechanism (not shown) may be provided to allow release of the lock mechanism from outside the building and/or via a remote intercom arrangement or the like.

FIG. 4A to 4E illustrates another example of a door or a window having latch arrangement 101 configured for fastening a panel 100 to a frame element 102. According to the present example the panel 100 is a panel of a hinged door and is configured to abut, in the closed state thereof, against a shoulder portion 104 defined on the frame element 102. The frame element 102 further defines a enclosure 105 for holding therein the latch arrangement 101, such that the frame facing portion 107 of the door panel 100 can be engaged by the latch arrangement 101, when the door is in the closed state thereof.

Figure 4A:
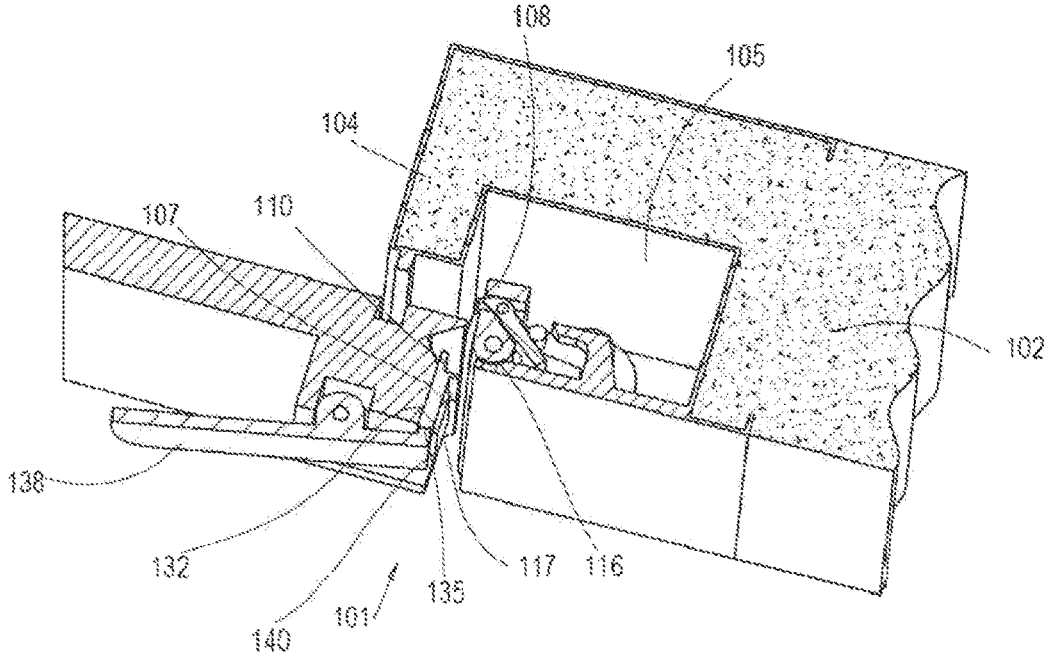
FIG. 4A is a perspective view of a panel having latch arrangement in accordance with another example of the presently disclosed subject matter.
Figure 4B:
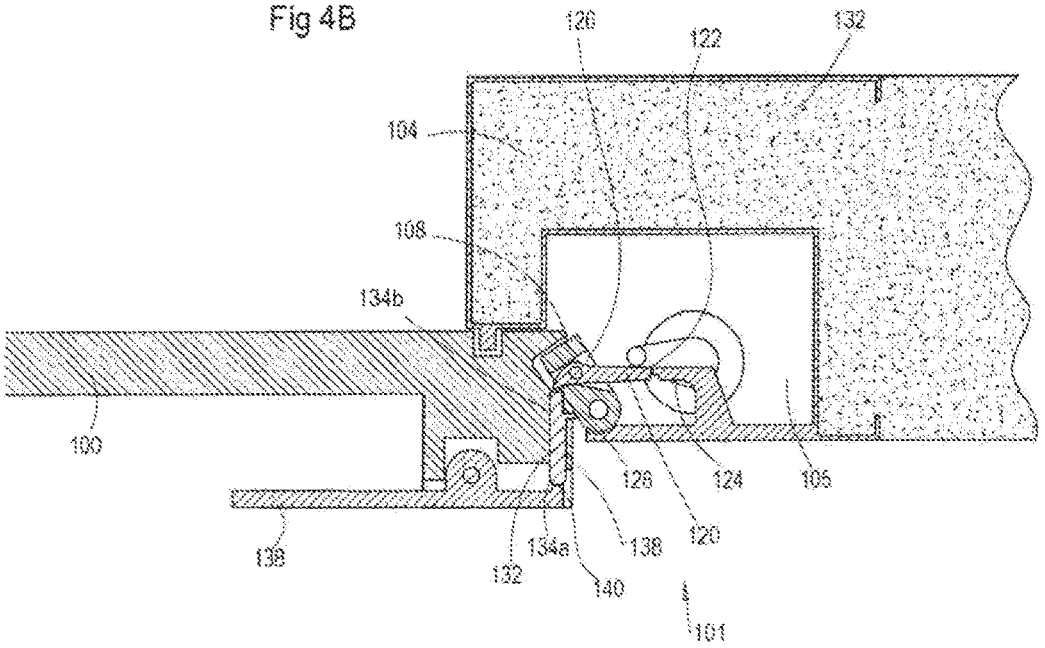
FIGS. 4B-4E are a sequence of top sectional views of the panel of FIG. 4A showing states of a latch arrangement including a stop latch during unlocking, illustrating the arrangement, respectively, in a fully locked state, a locked state with the stop latch disengaged, a fully unlocked state, and in a state of rest ready for closure of panel.
Figure 4C:
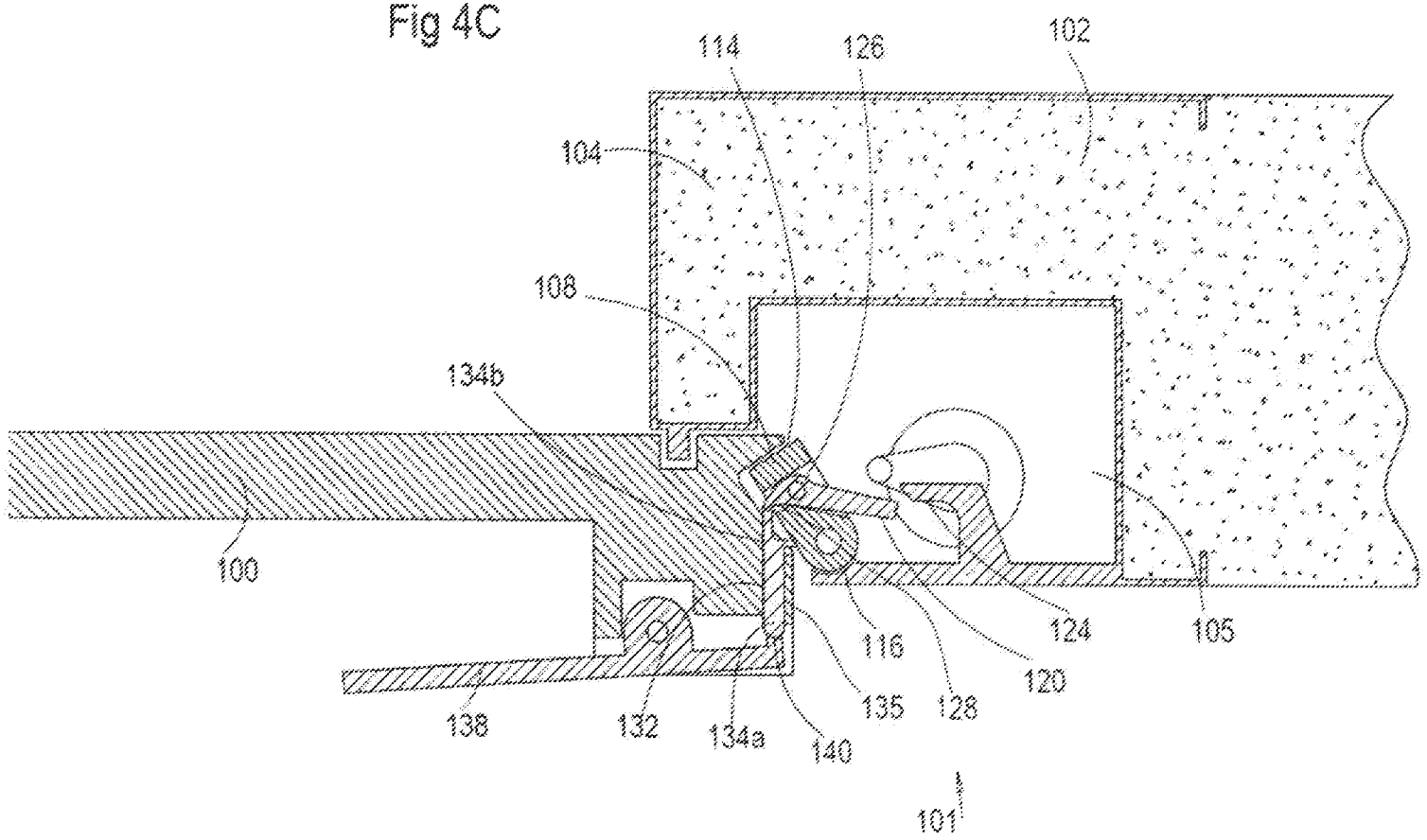
Figure 4D:
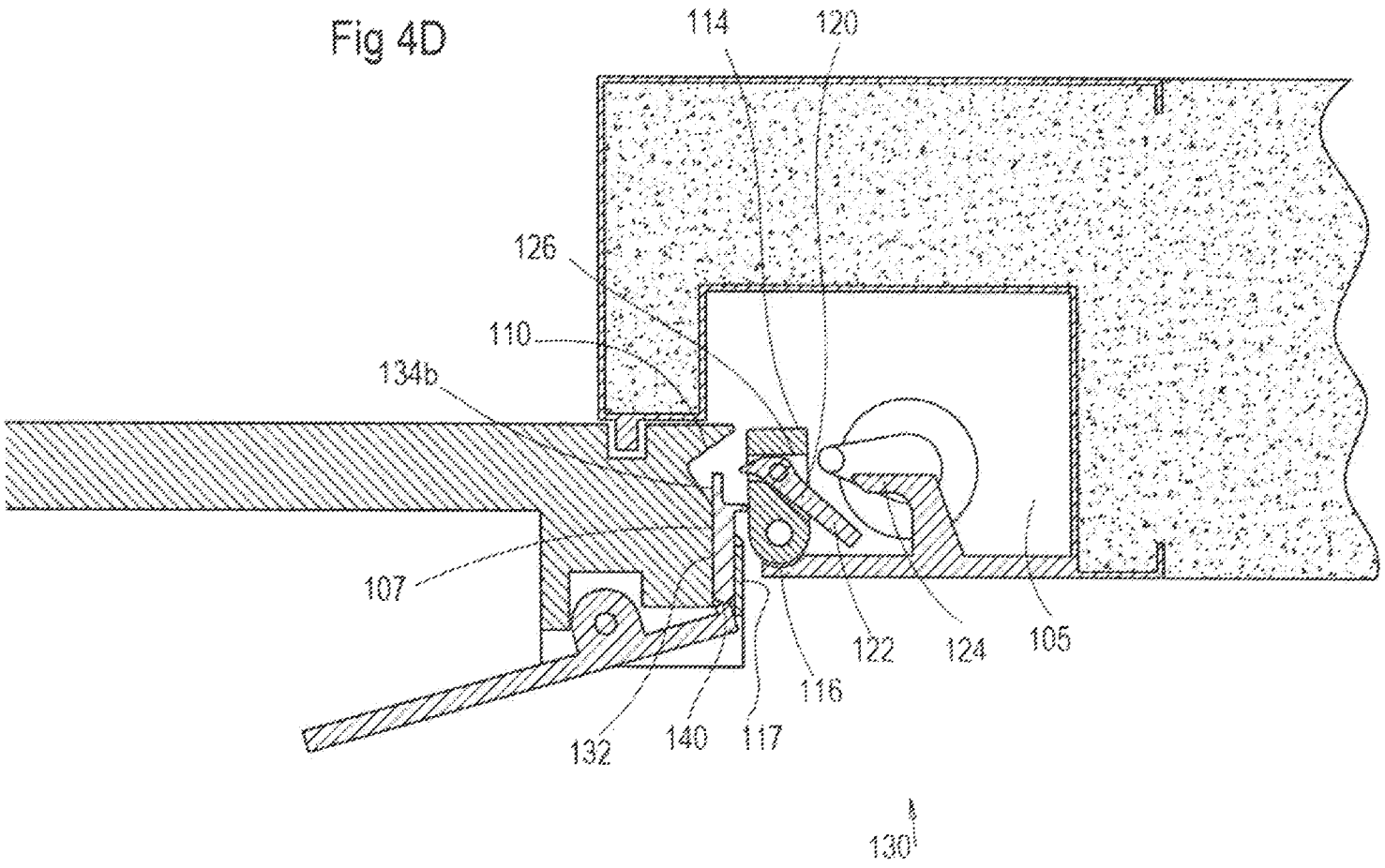
Figure 4E:
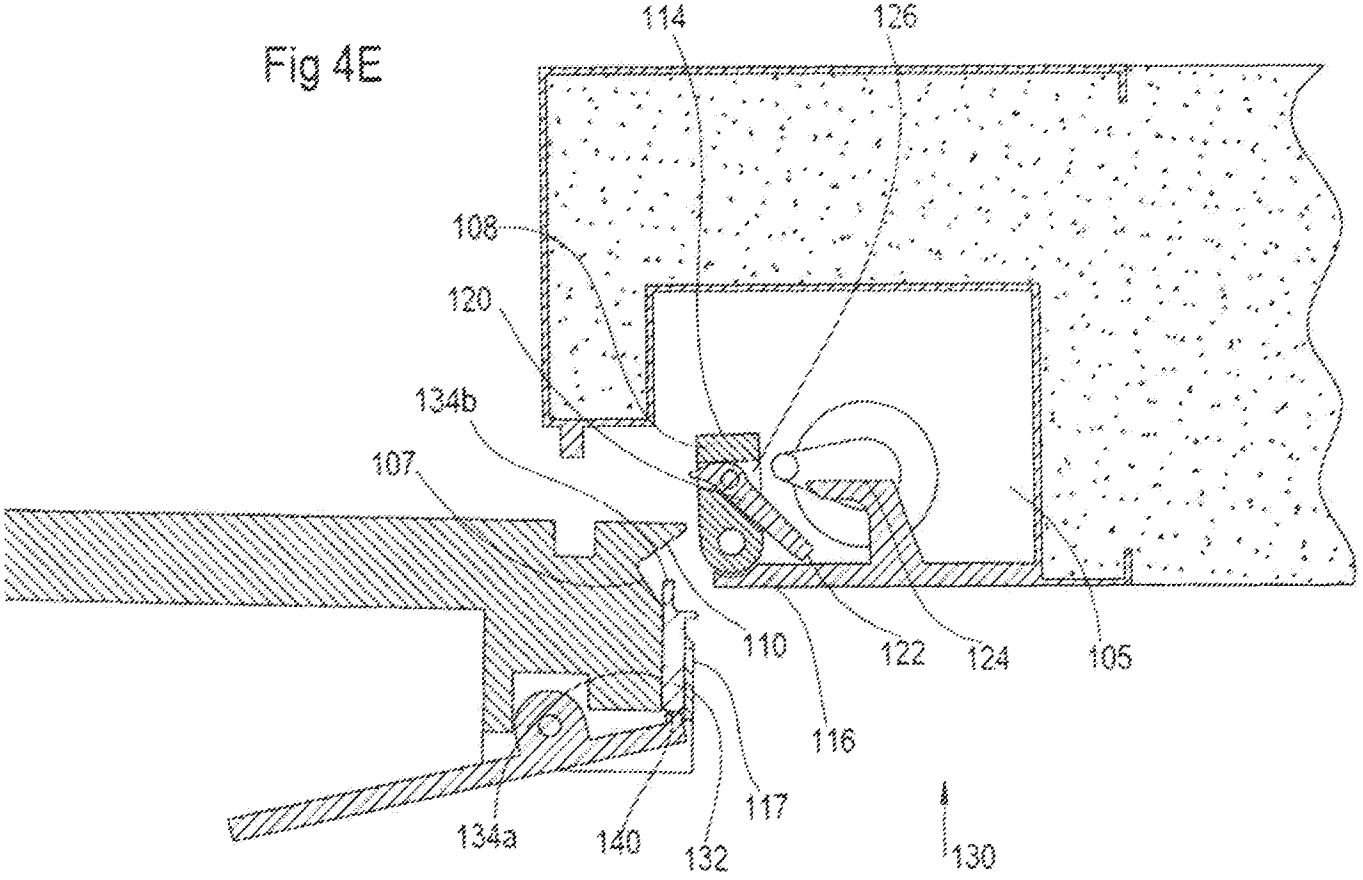

As in the previous examples, the latch arrangement 101, includes a locking element 108 pivotally mounted on the frame element 102 and displaceable between a locked position, as shown in FIGS. 4B and 4C, and an unlocked position shown in FIGS. 4A, 4D and 4E.

According to the present example however, the stop latch 120 is pivotally mounted on the locking element 108 as opposed to the previous example, in which the stop latch 60 is slidably mounted on the locking element 58. In addition, According to the present example the stop latch 120 is configured to abut against an abutment feature 124 defined on the frame element 102, this is as opposed to the previous example in which the stop latch 120 is configured to abut against a recess on the panel 50.

The locking element 108, can include a first end 114 configured to engage a depression 110 defined on the frame facing portion 107 of the door panel 100, and a second end 116 affixed to the frame element 102. In order to allow pivot of the locking element 108 about the second end 116, the latter has a rounded shape, and is mounted on a corresponding seat defined on the frame element 102.

According to an example, as shown in FIG. 4B, in the locked position, the locking element 108 is pivoted towards the panel 100 and away from the enclosure 105 and is disposed at an oblique angle with respect to the panel 100. The depression 110 on the frame facing portion 107, according to this example, is defined as a sloped cutaway which presents an angled surface with respect to the frame facing portion 107. The angle of the sloped cutaway depression 110 corresponds to the angle of the locking element 108 with respect to the panel 100, when the locking element 108 is in the locked position. This way, when the door panel 100 is in the closed state thereof and the locking element is pivoted to the locked position, the first end 114 of the locking element 108 is engaged with the cutaway depression 110, locking thereby the panel 100 to the frame element 102. It should be noted that the term "cutaway" is used herein as descriptive of the final form of depression 110, without in any way limiting the manufacturing technique used to produce the configuration, which does not necessarily include "cutting".

When the locking element 108 is pivoted away from the cutaway depression 110, the first end 114 of the locking element 108 is disengaged from the cutaway depression 110 on the panel 100, such that the latter is unlocked and can freely rotate to the opened state thereof, as shown in FIGS. 4D and 4E.

It is appreciated that the locking element 108 can extend along the entire or the majority of the length of the frame element, such that in the locked position it is engaged with the cutaway depression 110 which can also be defined along the entire or the majority of the length of the frame facing portion 107.

As indicated above, the stop latch 120 of the present example, is pivotally mounted on the locking element 108 and is configured to secure the locking element 108 in the locked position. For example, the stop latch 120 can include a tail portion 122 extending into the enclosure 105 and configured to selectively engage an abutment feature 124 defined on the frame element 102. The stop latch 120 further includes a head tip 128 defined on an end of the stop latch 120, opposing the tail portion 122 and extending towards the frame facing portion 107.

The stop latch 120 is configured to pivot between a secured position, in which the locking element 108 is secured in the locked position thereof, and a released position in which the locking element 108 is free to pivot towards the enclosure 55 disengaging thereby the cutaway depression 110 of the panel 100.

In the secured position, shown in FIG. 4B, the tail portion 122 is engaged with the abutment feature 124 such that pivoting of the locking element 108 towards the enclosure is precluded, and the latter is maintained in the locked position thereof. In the released position, on the other hand, the stop latch 120 is slightly pivoted such that the tail portion 122 is disengaged from the abutment feature 124 such that the displacement of the locking element 108 away from the depression 110 to the unlocked position is no longer precluded.

According to an example, the stop latch 120 is mounted in a channel 126 defined along the width of the locking element 108, such that the stop latch can extend between the abutment feature 124 inside the enclosure 105 and the frame facing portion 107. The width of the channel 126 is slightly larger than the width of the stop latch 120 in such a way that the latter can pivot inside the channel 126. It is appreciated that the maximum pivoting angle of the stop latch 120 can be thus determined by the width of the channel 126.

This way, pivoting of the stop latch 120 to the released position thereof can be carried out by sidewardly pushing the head tip 128, disengaging thereby the tail portion 122 from the abutment feature 124 inside the enclosure 105.

The latch arrangement 101 further includes an actuating mechanism 130 configured to displace the locking element 108 to the unlocked position. According to the illustrated example the actuating mechanism 130 is further configured to pivot the stop latch 120 to the released position thereof such that the locking element 108 is unsecured and can be pivoted to the unlocked position.

The actuating mechanism 130 includes an actuating member 132 slidably mounted on the panel, for example inside a groove 135 defined in close proximity to the frame facing portion 107 and extending transversely with respect to the panel 100. The actuating member 132 includes a first end 134*a* facing an outer surface of the panel 100 and a second end 134*b* facing the head tip 128.

The actuating mechanism 130 further includes a manually operable handle 138 pivotally mounted on the panel 100, such that when a first end thereof is pivoted away from the panel 100, a second end 140 thereof is pushed towards the panel, as shown in FIG. 2D. The second end 140 of the handle 138 is configured to engage the first end 134*a* of the actuating member 132.

This way, when the handle 138 is pivoted away from the panel 100 the actuating member 132 is pushed by the second end 140 of the handle 138 and is urged to slide and to push thereby the head tip 128 of the stop latch 120. As a result, the stop latch 120 pivots to the released position thereof such that the tail portion 122 disengages the abutment feature 124 inside the enclosure 105, and the locking element 108 is free to pivot away from the depression 110.

As explained hereinabove, the channel 126 in which the stop latch 120 is mounted is so configured to allow a predetermined pivoting angle, such that when the stop latch 120 is pivoted to the maximum pivoting angle, the tail portion 122 of the stop latch 120 abuts the inner wall of the channel 126. Accordingly, further displacement of the actuating member 132 causes the second end 134*b* thereof to further push the head tip 128 of the stop latch 120 which can no longer pivot, thus causing displacement of the locking element 108 in which the stop latch 120 is mounted away from the depression 110.

This way, a single pivoting motion of the handle 138 such that the first end thereof is pulled away from the panel 100, shifts the stop latch 120 to the released position thereof, immediately following by pivoting of the locking element 108 to the unlocked position.

As shown in FIG. 4E, according to the illustrated example, the handle 138 is so mounted on the panel 100, such that pivoting thereof towards an opening direction of the panel causes the actuating member 132 to displace the stop latch 120 to the released position thereof, and the locking element 108 to the unlocked position thereof. This way, when it is desired to unlock and open the door panel 100 a single motion in one direction is required.

It is appreciated that the locking element 108 can include a return mechanism (not shown) configured to urge the locking element 108 away from the enclosure 105 to the locked position. Similarly, the stop latch 120 can be biased to normally be disposed in the secure position thereof.

FIGS. 5A through 6B show a door or a window having latch arrangement 151 according to another example, configured for fastening a panel 150 to the frame element 152. As in the previous example, the panel is a panel of a hinged door and is configured to abut, in the closed state thereof, against a shoulder portion 154 defined on the frame element 152, which includes a enclosure 155 for holding therein the latch arrangement 151. In addition the panel includes a handle 182, pivotally mounted in close proximity to the end thereof, and is configured to allow opening of the panel 150 as explained hereinafter in detail.

Figure 5A:
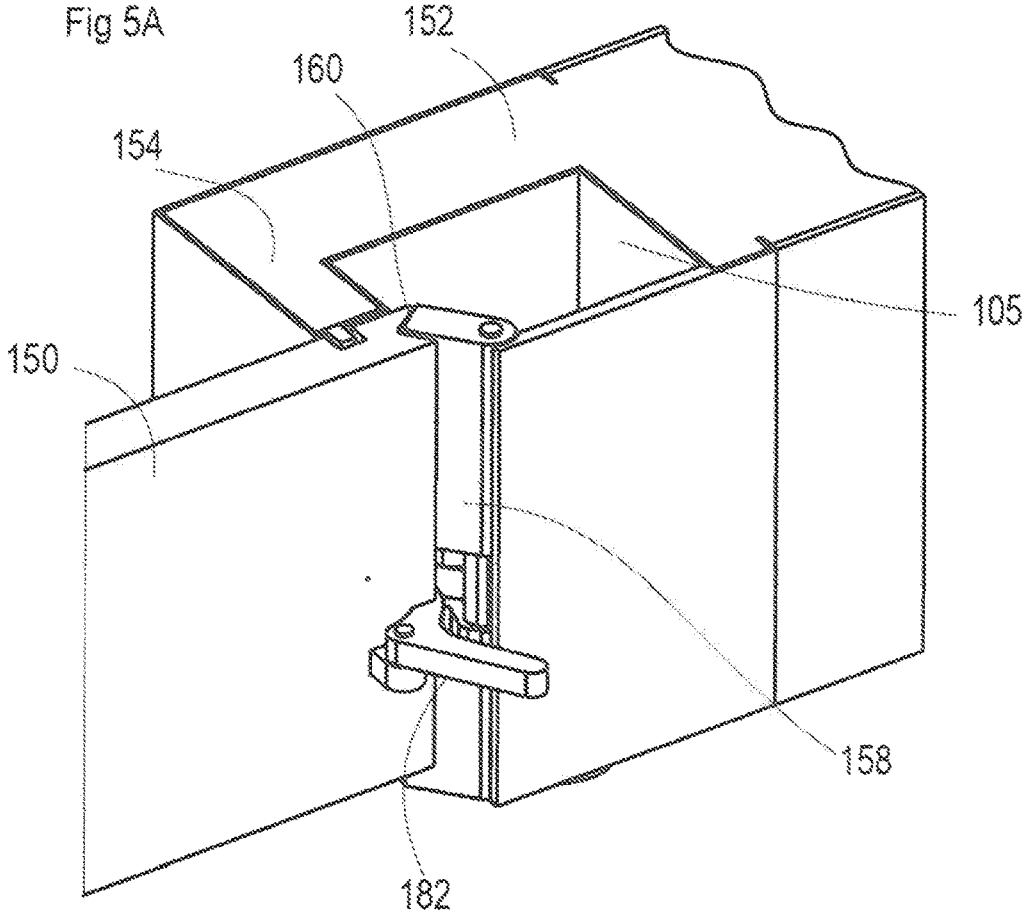
FIG. 5A is a perspective view of a panel having latch arrangement in accordance with another example of the presently disclosed subject matter.
Figure 5B:
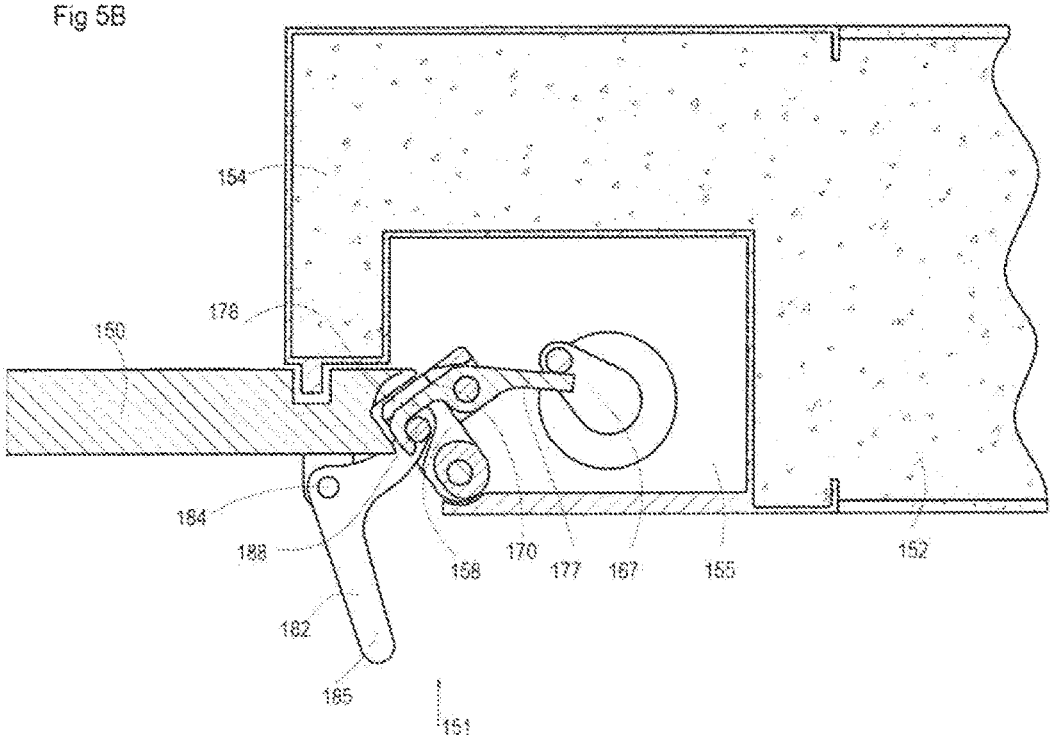
FIGS. 5B-5E are a sequence of top sectional views of the panel of FIG. 5A showing states of a latch arrangement including a stop latch during unlocking, illustrating the arrangement, respectively, in a fully locked state, a locked state with the stop latch disengaged, a transition state, a fully unlocked state, and in a state of rest ready for closure of panel.
Figure 5C:
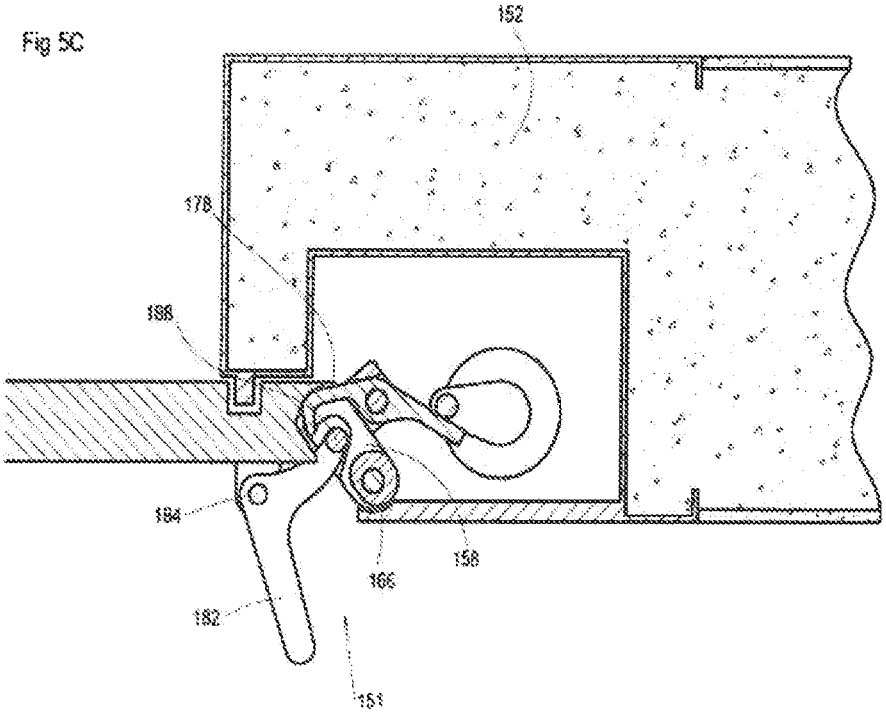
Figure 5D:
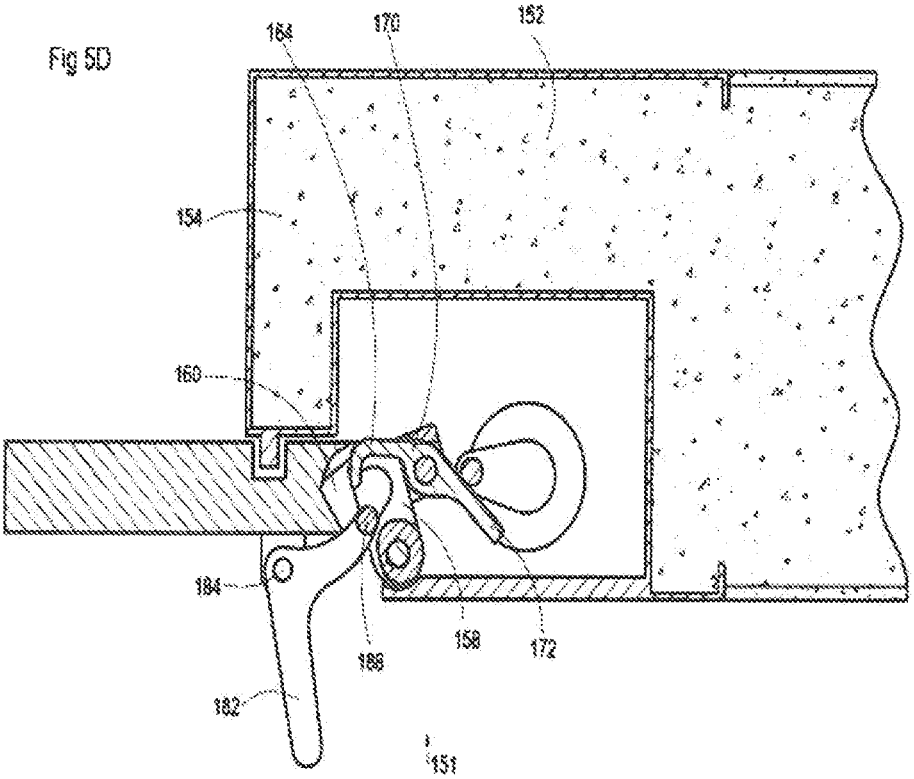

As in the previous example, the latch arrangement 151 includes a locking element 158 pivotally mounted on the frame element 152 and is displaceable between a locked position, as shown in FIG. 5B, and an unlocked position shown in FIGS. 5D, and 3E. In addition, as in the previous example, the latch arrangement 151 includes a stop latch 170 selectively deployable to secure the locking element 158 in the locked position.

Further, as in previous example, actuating the locking element 158 and the stop latch 170 can be carried out either by a manual actuator 187 pivotally mounted on the door panel 150, or by a rotating actuator 167 mounted inside the enclosure 155.

It should be noted however that according to the present example, the stop latch 170 is configured to secure the locking element 158 by engaging a catch member 188 on the manual actuator 187, which is mounted to the panel 150. This is as opposed to the example of FIGS. 4A to 4E, in which the stop latch 170 is configured to secure the locking element 158 by engaging an abutment feature mounted on the frame element 152.

A detailed explanation of the present example is followed with reference to FIGS. 5B to 5E. The locking element 158 includes a first end 164 configured to engage a depression 160 defined on the frame facing portion 157 of the door panel 150, and a second end 166 affixed to the frame element 152. As shown in FIG. 5B, in the locked position, the locking element 158 is pivoted towards the panel 150 and is disposed at an oblique angle with respect to the panel 150. This way, in the locked position the first end 164 of the locking element 158 is engaged with the cutaway depression 160, locking thereby the panel 150 to the frame element 152, and in the unlocked position the locking element 158 is pivoted away from the cutaway depression 160, such that the panel 150 is unlocked and can freely rotate to the opened state thereof, as shown in FIG. 3E.

The stop latch 170 according to the present example is pivotally mounted on the locking element 158 and includes a tail portion 172 extending into the enclosure 155 and configured to engage the rotating actuator 167 mounted inside the enclosure 155. In addition the locking element 158 includes a hook 178 defined on an end of the stop latch 170 opposing the tail portion 172 and extending towards the frame facing portion 157.

The hook 178 is configured to engage a catch member 188 defined on the manual actuator 187 of the panel 150, such that the locking element 158 is secured in the locked position thereof.

Thus, the stop latch 170 is configured to pivot between a secured position, in which the locking element 158 is secured in the locked position thereof by the engagement of the hook 178 with the catch member 188, and a released position in which the locking element 158 is free to pivot towards the enclosure 155 disengaging thereby the cutaway depression 160 of the panel 150.

As mentioned above, the latch arrangement 151 according to the present example includes rotating actuator 167 mounted inside the enclosure 155. The rotating actuator 167 is configured to selectively rotate in a first and a second direction in a motion parallel to the pivoting motion of the stop latch 170, while engaging the tail portion 172 of the stop latch 170. Alternatively, the rotating actuator 167 can be configured to rotate in a single direction such that following a full cycle or rotation the stop latch 170 is pivoted back to its original location, i.e. a secured position.

As shown in FIGS. 5C and 5D, when the rotating actuator 167 is rotated in a first direction, the rotational motion thereof urges the tail portion 172 of the stop latch 170 to pivot until the hook 178 on the other end of the stop latch 170 disengages the catch member 188 on the manual actuator 187, and the stop latch 170 is displaced to the released position.

The pivoting angle of the stop latch 170 can be limited by engagement with the locking element 158, such that further rotation of the rotating actuator 167 in the first direction urges the locking element 158 to pivot away from the depression 160 to the unlocked position thereof, as shown in FIG. 5D.

Figure 5E:
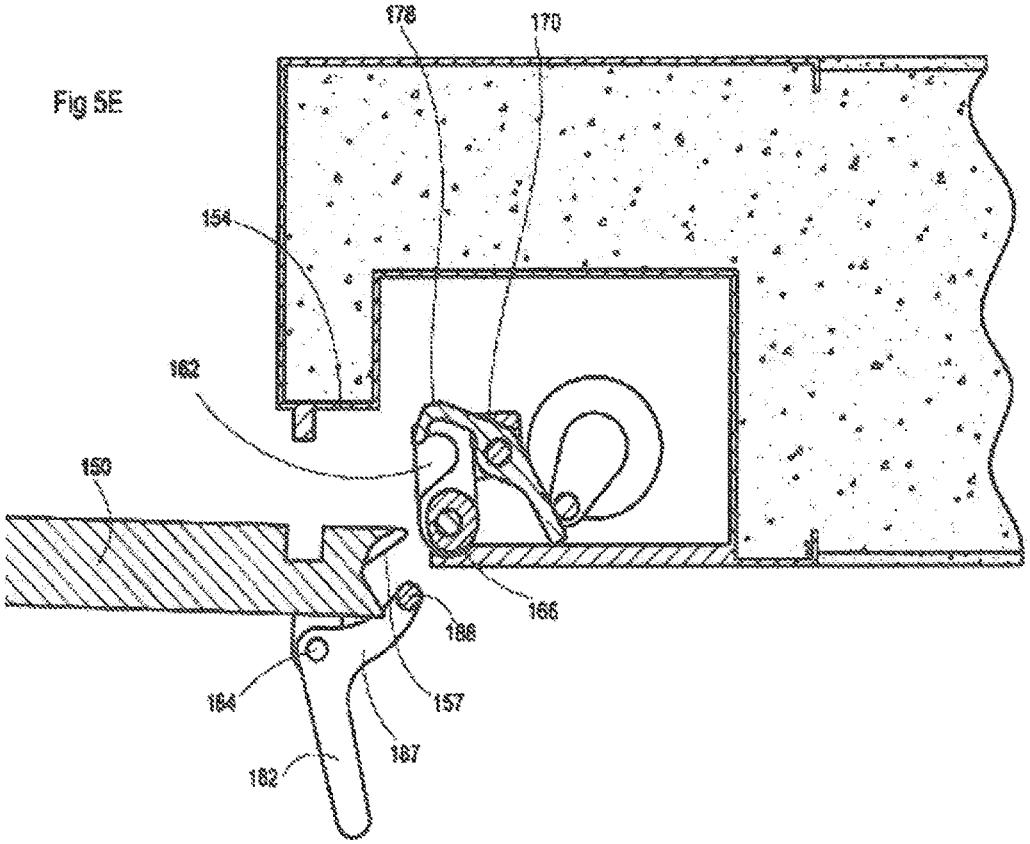

With reference to FIG. 5E, as the locking element 158 is pivoted away from the depression 160 and completely disengaged therefrom, the door panel 150 can be pulled by the handle 182 to the opened state thereof.

The rotating actuator 167 can be rotated in a second direction, such that the tail portion 172 of the stop latch 170 can be pivoted back to the secured position and the locking element 158 is pivoted back to the locked position. It is appreciated that the pivoting of the stop latch 170 and the locking element 158 back to the secured and locked position, respectively, can be carried out by a return mechanism, such as a spring (not shown), etc. Accordingly, the rotating actuator 167 is configured to oppose the force of such return mechanism when the rotating actuator 167 is rotated in the first direction. When the rotating actuator 167 is rotated in the second direction however, the stop latch 170 and the locking element 158 are urged back to the secured and locked position, respectively, by the forces of the return mechanism.

It will be appreciated that the rotating actuator 167 can be replaced with a liner actuator configured to pivot the stop latch 170 and the locking element 158.

As indicted above, according to the present example actuating the locking element 158 and the stop latch 170 can be carried out by means of a manual actuator 187 pivotally mounted on the door panel 150. The manual actuator 187 can be integrally formed with a handle 182 including a grip 185 and the manual actuator 187. The handle 182 can be configured to pivot on the panel 150 about a pivoting point 184 defined between the grip 185 and a manual actuator 187. According to the present example, the manual actuator 187 is configured to engage a recess 162 defined on the locking element 158 in the locked position, as shown in FIG. 5B.

As noted above, according to the present example, the actuating mechanism for displacing the locking element between the locked and unlocked position includes a manual actuator 187 and a rotating actuator 167. It is appreciated that the manual actuator 187 and the rotating actuator 167 can operate independently from one another.

Figure 6A:
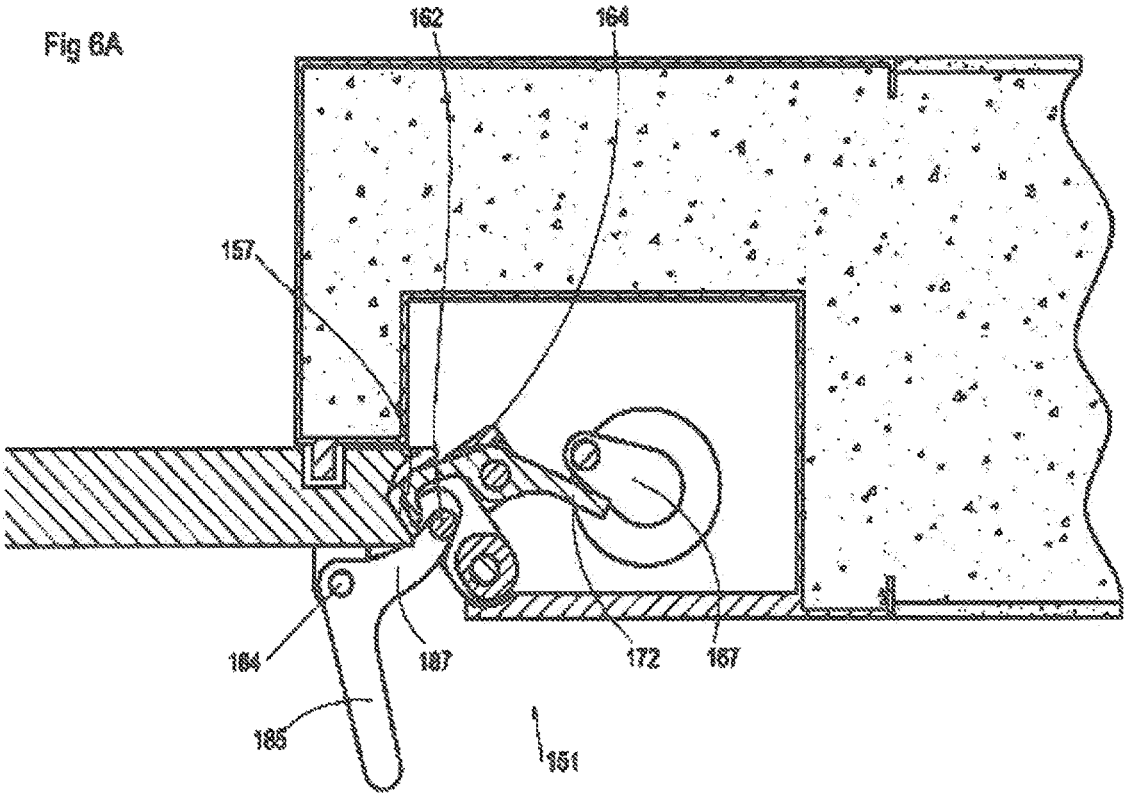
FIG. 6A is a top sectional view of the panel of FIG. 5A in another locked position of the latch arrangement.
Figure 6B:
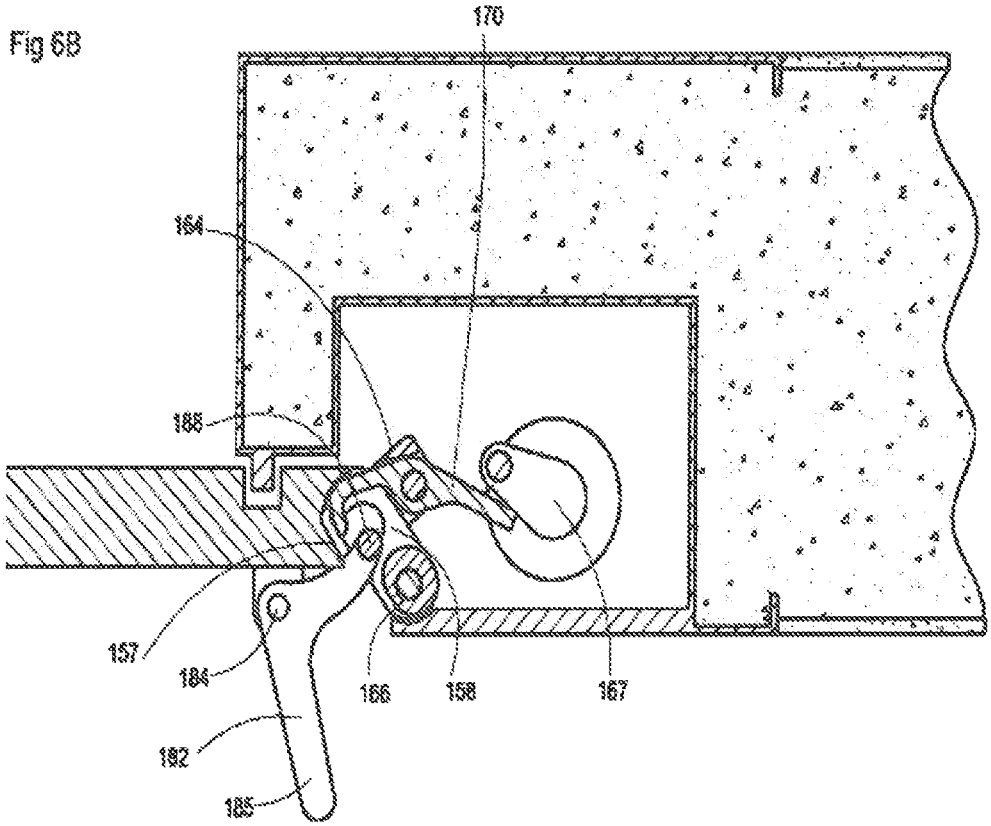
FIG. 6B is a top sectional view of the panel of FIG. 5A in a another unlocked position of the latch arrangement.

Turning now to FIGS. 6A and 6B, in which the operation of the manual actuator 187 is illustrated. For manual opening of the door panel 150, the handle 182 can be pivoted towards an opening direction of the panel 150, causing thereby the manual actuator 187 to slide out of the recess 162 disengaging thereby the catch member 188 from the hook 178, such that the locking element 158 is no longer secured by the stop latch 170 and the catch member 188. As shown in FIG. 4B, further pivoting of the handle 182 towards an opening direction of the panel 150, causes the manual actuator 187 to push the locking element 158 away from the depression 160 to the unlocked position.

FIGS. 7A to 7E show a latch arrangement 201 configured for fastening a panel 200 of a sliding door to a frame element 202, this is as opposed to the previous example, in which the panel is a panel of a hinged door. Similar to the previous examples the latch arrangement 201 includes a locking element 210 pivotally mounted on the frame element 202 and an actuating mechanism including a manually operable handle 212 mounted on the panel 200 and being configured to interact with the locking element 210 to lock the panel to the frame element 202.

The frame element 202 includes a first side portion 204*a* coupled to a second side portion 204*b* and being spaced apart from the first side portion 204*a* defining thereby a enclosure 206 therebetween. The enclosure 206 is configured for receiving therein an end segment of the panel 200.

The frame element 202 further includes an abutting portion 208 transversely extending inside the enclosure 206 from the first side portion 204*a* defining an opening 205 between an edge thereof and the second side portion 204*b*. The opening 205 is configured to allow sliding of the end segment of the panel 200 therethrough into the enclosure 206.

According to this example, the panel 200 can include a depression having shoulder portion 209 protruding from the surface of the panel 200 towards the first side portion 204*a* of the frame element 202.

Figure 7A:
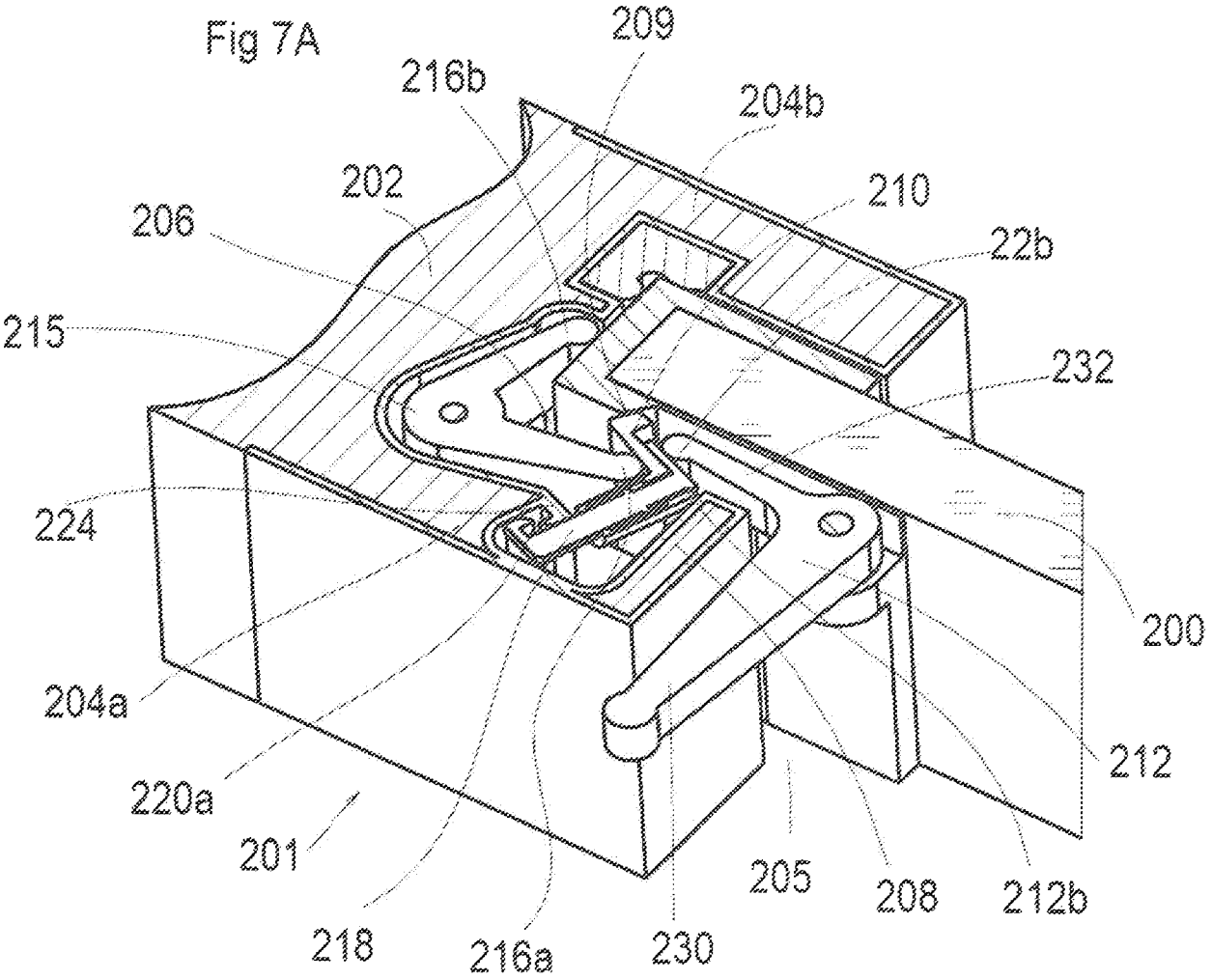
FIG. 7A is a perspective view of a panel having latch arrangement in accordance with yet another example of the presently disclosed subject matter.
Figure 7C:
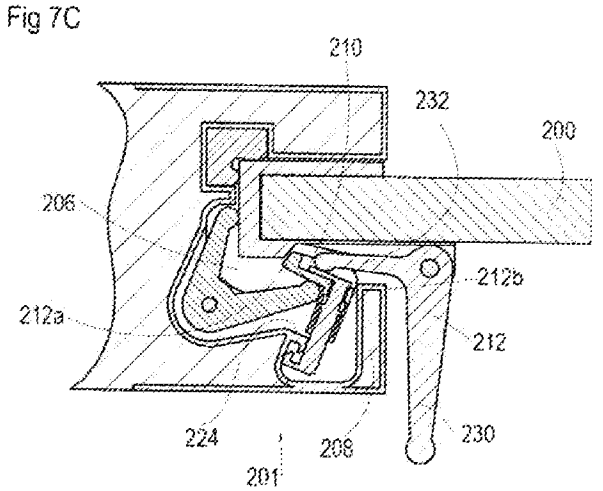
FIGS. 7B-7E are a sequence of top sectional views of the panel of FIG. 7A showing states of a latch arrangement including a stop latch during unlocking, illustrating the arrangement, respectively, in a fully locked state, a locked state with the stop latch disengaged, a fully unlocked state, and in a state of rest ready for closure of panel.
Figure 7E:
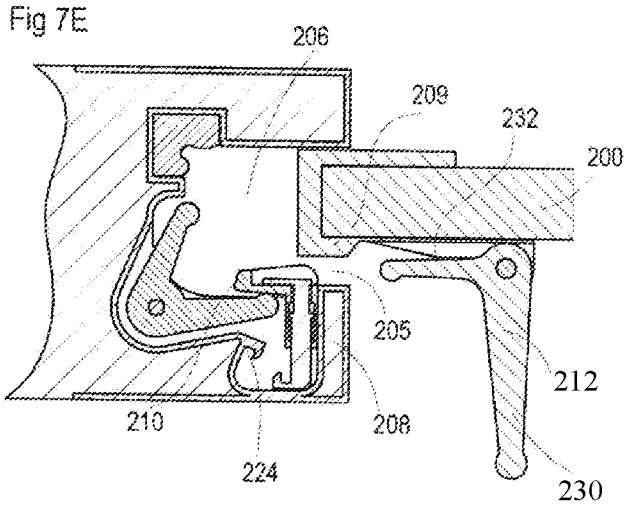
Figure 7B:
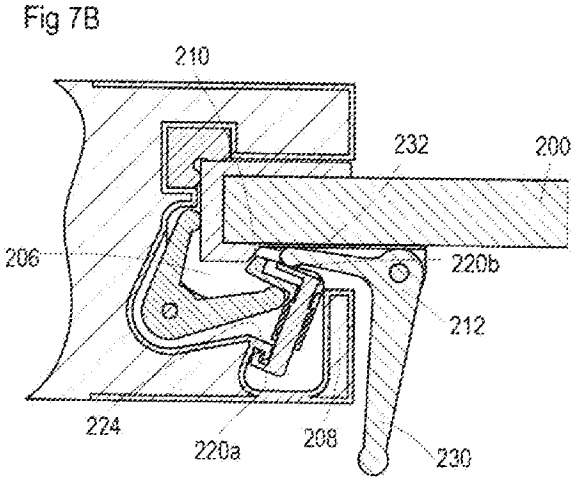
Figure 7D:
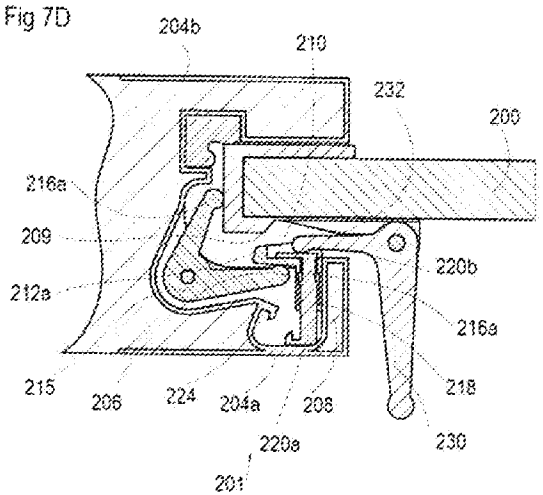

The locking element 210 include a first end 212*a* and a second end 212*b*, and is disposed in the enclosure 206 and displaceable between a locked position (FIGS. 7A and 7B) and an unlocked position (FIGS. 7D and 7E). In the locked position the first end 212*a* of the locking element 210 is engaged with shoulder portion 209 of the panel 200, while the second end 212*b* is engaged with the abutting portion 208 of the frame element 202 precluding thereby the sliding of the panel 200 out of the enclosure 206. In the unlocked position the locking element 210 is pivoted such that the first end 212*a* of the locking element 210 is disengaged from the shoulder portion 209 of the panel 200 such the panel 200 is free to be slid away from the frame element 202 to the open state thereof.

According to an example, the locking element 210 in the locked position is extended at an oblique angle with respect to the panel 200 such that the first end 212*a* is engaged with the shoulder portion 209 which can also be formed with a corresponding angle. It is appreciated that the shoulder portion 209 can be integrally formed with the panel 200 or can be a profile attached thereto. This way, in the locked position of the locking element 210 the displacement of the panel 200 towards an opening direction of the panel is opposed by compressive forces exerted between the locking element 208 and the butting portion 208 of the frame element 202.

The latch arrangement 201 can further include a positive lock member 215 pivotally mounted inside the enclosure 208 and having a first arm 216*a* and a second arm 216*b*. The first arm 216*a* is configured to engage an edge of the panel 200 when in the closed state, and the second arm 216*b* is configured to engage a surface of the locking element 210. The positive lock member 215 is configured such the when the panel 200 is slid into the enclosure 208 to the closed state thereof, the edge of the panel 200 engages the first arm 216*a* and pushes it in a direction parallel to the closing direction of the panel 200. As a result, the positive lock member 215 is pivoted and the second arm 216*b* urges the locking element 210 to the locked position, i.e. the first end 212*a* is engaged with the shoulder portion 209. Thus, the positive lock member 215 allows an autonomous displacement of the locking element 210 to the locked position thereof upon closing of the door panel 200.

As in the previous example, the latch arrangement 201 further includes a stop latch 218 selectively deployable to secure the locking element 210 in the locked position. The stop latch 218 is slidably mounted inside the locking element 210 and include a hook portion 220*a* defined on one end thereof and an engaging portion 220*b* defined on an opposing end thereof. The stop latch 218 is configured to slide inside the locking element 210 while the hook portion 220*a* is disposed on one side of the locking element 210 while the engaging portion 220*b* is disposed on a second side of the locking element 210. The stop latch 218 is configured to slide between a secured position in which the hook portion 220*a* is engaged with an abutment feature in a form of a catch member 224 on the frame element 202, and a released position in which the hook portion 220*a* is disengaged from the catch member 224.

The hook portion 220*a* of the stop latch 218 and the catch member 224 on the frame element 202 are configured to be engaged to one another when the locking element 210 is pivoted to the locked position thereof. That is to say, catch member 224 on the frame element 202 is disposed in parallel with the sliding axis of the stop latch 218, when the locking element 210 is in the locked position. This way, at this position, as shown in FIGS. 7B and 7C, the stop latch 218 can be selectively slid between a secured position in which the hook portion 220*a* is engaged with the catch member 224 on the frame element 202, precluding thereby the pivoting of the locking element 210 to the unlocked position thereof, and a released position in which the hook portion 220*a* is disengaged from the catch member 224, and the locking element 210 is free to pivot to the unlocked position thereof.

Since the stop latch 218 is mounted on the locking element 210, when the latter is pivoted to the unlocked position thereof, the catch member 224 is no longer parallel to the sliding axis of the stop latch 218 and the hook portion 220*a* can no longer be engaged with the catch member 224, as shown in FIG. 7D. At this position, the panel 200 can be slid out of the enclosure 206 as shown in FIG. 7F.

The stop latch 218 can be biased by a spring member (not shown) mounted inside the locking element 210 urging the stop latch 218 to the secured position thereof.

The latch arrangement 201 further includes an actuating mechanism including a manually operable handle 212 mounted on the panel 200 and being configured to interact with the locking element 210 to lock the panel to the frame element 202.

According to the illustrated example, the handle 212 is pivotally mounted on the panel 200 and includes a grip 230 and an actuating member 232. The actuating member 232 is disposed in close proximity with the surface of the panel 200, while the grip 230 protrudes away from the surface of the panel 200 such that it can be griped.

The handle 212 is mounted such that when the edge of the panel 200 is inserted inside the enclosure 206, the actuating member 232 is inserted therewith and is configured to engage the engaging portion 220*b* of the stop latch 218.

The handle 212 can be pivoted between a first position in which the actuating member 232 is pivoted towards the surface of the panel 200 and a second position in which the actuating member 232 is pivoted away the surface of the panel 200. As shown in FIG. 7C, when the panel is in the closed state thereof pivoting the handle 212 to the second position causes the actuating member 232 to engage the engaging portion 220*b* of the stop latch 218, and to urge the stop latch 218 to slide to the released position thereof. At this position the hook portion 220*a* is disengaged from the catch member 224, and the locking element 210 is free to pivot to the unlocked position thereof.

As can be seen in FIG. 7C, the sliding of the stop latch 218 inside the locking element 210 is limited by the engaging portion 220*b* abutting against the locking element 210. Thus further pivoting of the handle 212 causes the engaging portion 220*b* to urge the locking element 210 to pivot to the unlocked position thereof, as shown in FIG. 6D.

This way, a single motion of pivoting the handle 212 such that the actuating member 232 thereof is pulled away from the panel 200, shifts the stop latch 218 to the released position thereof, immediately following by pivoting of the locking element 210 to the unlocked position.

As shown in FIG. 7E, according to the illustrated example, the handle 212 is so mounted on the panel 200, such that pivoting of the grip 230 towards an opening direction of the panel 200 causes the actuating member 232 to displace the stop latch 218 to the released position thereof, and the locking element 210 to the unlocked position thereof. This way, when it is desired to unlock and open the door panel 200 a single motion of pulling the grip 230 in one direction is required.

FIGS. 8A to 8E illustrates a latch arrangement 251 for fastening a panel 250 of a hinge door to a frame element 252. As in the previous example, the panel 250 is configured to abut, in the closed state thereof, against a shoulder portion 254 defined on the frame element 252 on which the latch arrangement 251 is mounted.

Figure 8A:
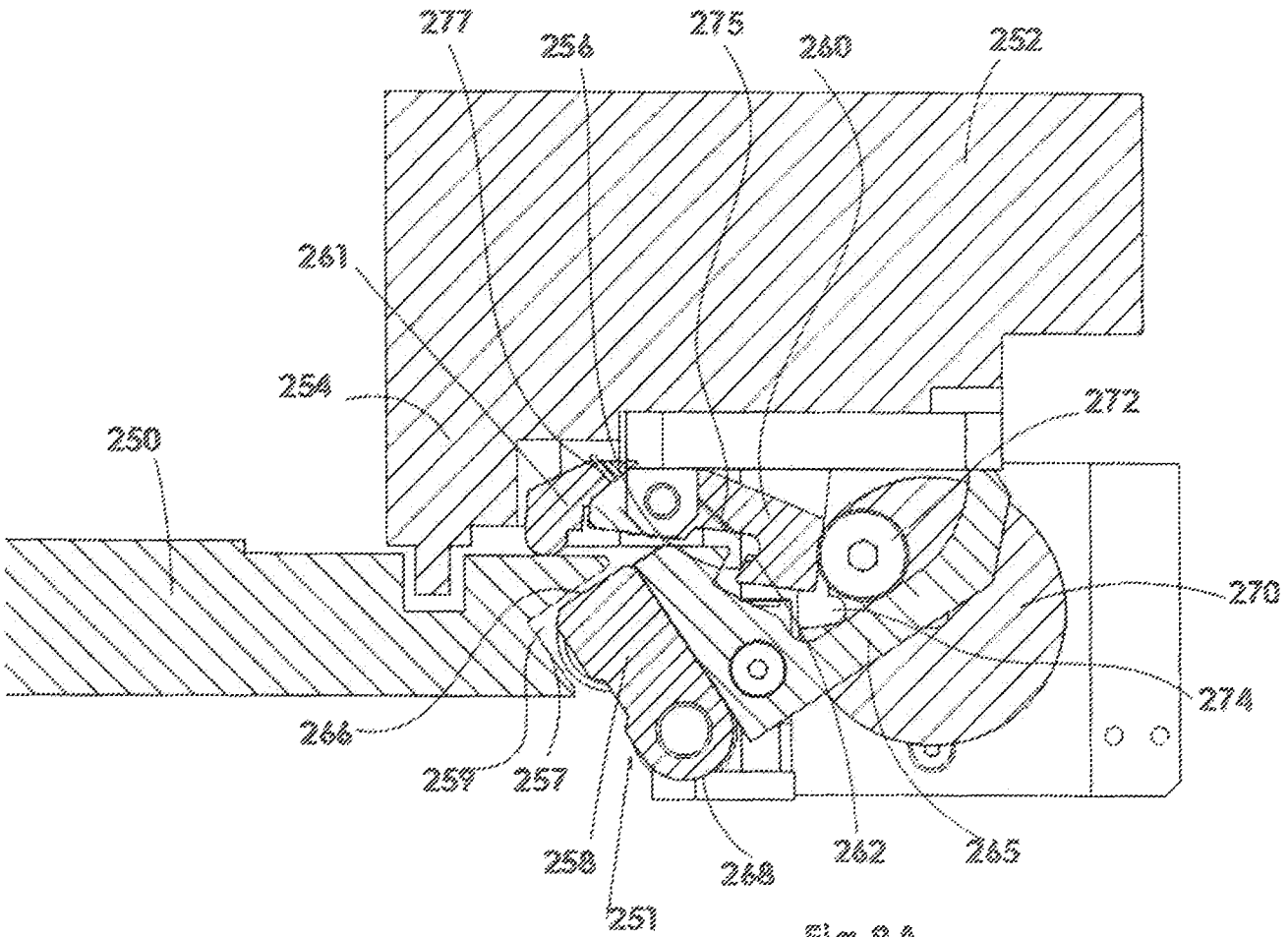
FIG. 8A is a top view of a panel having latch arrangement in accordance with another example of the presently disclosed subject matter.
Figure 8C:
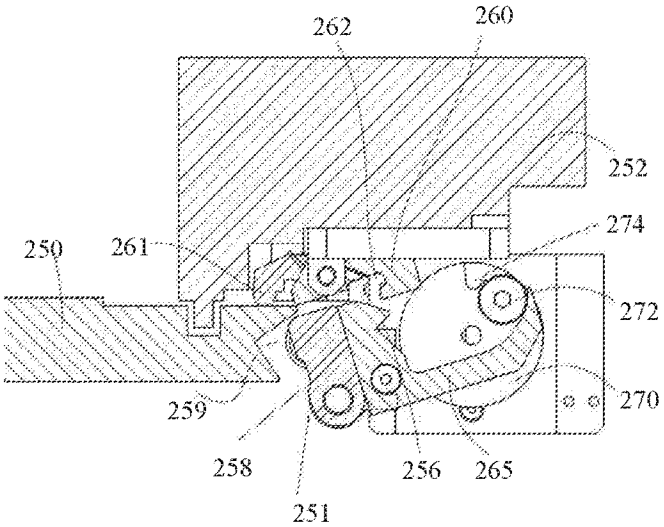
FIGS. 8B-8E are a sequence of top sectional views of the panel of FIG. 8A showing states of a latch arrangement including a stop latch during unlocking, illustrating the arrangement, respectively, in a fully locked state, a locked state with the stop latch disengaged, a transition state, a fully unlocked state, and in a state of rest ready for closure of panel.
Figure 8E:
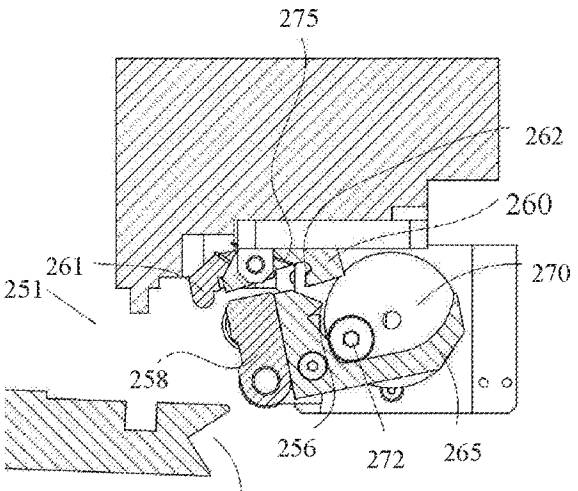
Figure 8B:
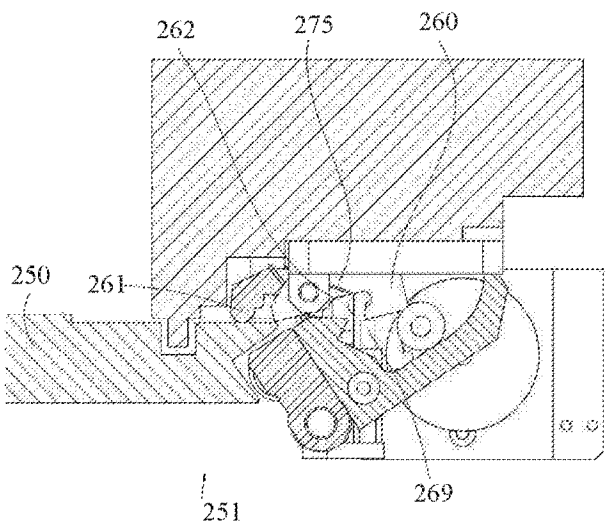
Figure 8D:
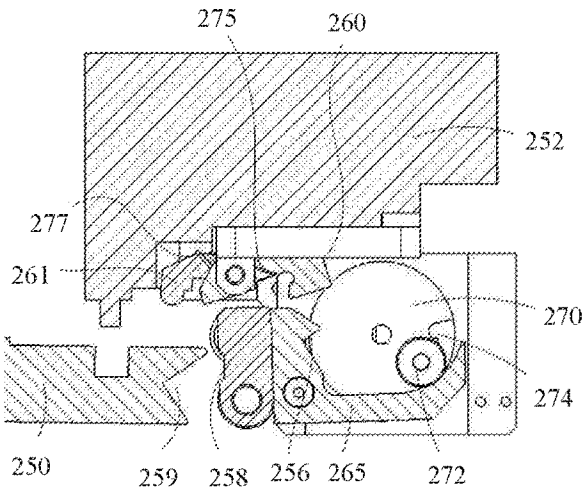

As in the previous example, the latch arrangement 251 includes a locking element 258 pivotally mounted on the frame element 252 and displaceable between a locked position, as shown in FIG. 8A, and an unlocked position shown in FIGS. 8D, and 8E. In addition, as in the previous example, the latch arrangement 251 includes a stop latch 260 selectively deployable to secure the locking element 258 in the locked position.

According to the present example however, the stop latch 260 is pivotally mounted frame element 252 and is configured to pivot between a secured position in which at least one portion of the stop latch 260 is engaged with an abutment feature in a form of a catch member 256 defined on or couple to the locking element 258, and a released position in which at least one portion of the stop latch 260 is retracted away from the catch member 256. This is in contrast of the previous examples in which the stop latch is mounted on the locking element and is configured to selectively engage an abutment feature on the frame element or on the panel.

The following is a detailed explanation of the example of FIGS. 8A to 8E. The locking element 258 includes a first end 266 configured to engage a depression 259 defined on a frame facing portion 257 of the panel 250, and a second end 268 affixed to the frame element 252. As shown in FIG. 8A, in the locked position, the locking element 258 is pivoted towards the panel 250 and is disposed at an oblique angle with respect to the panel 250. This way, in the locked position the first end 266 of the locking element 258 is engaged with the depression 259, locking thereby the panel 250 to the frame element 252, and in the unlocked position the locking element 258 is pivoted away from the depression 259, such that the panel 250 is unlocked and can freely rotate to the opened state thereof, as shown in FIGS. 8D and 8E.

As indicated above, the stop latch 260 according to the present example is pivotally mounted on the frame element 252 and includes a hook 262 which is configured to engage in the secured position of the stop latch 260 the catch member 256 coupled to the locking element 258.

The stop latch 260 includes a panel abutting member 261 which is pivotally coupled to the stop latch 260 about the same axis of which the stop latch 260 is pivotally mounted to the frame element 252.

The abutting member 261 generally tends to pivot towards the stop latch 260 under the force of a contracting spring 277. Thus, when the panel 250 is in the closed state thereof, the panel 250 pushes the abutting member 261, and causes it to pivot towards the frame element 252. Since the contracting spring 277 urges the stop latch 260 to maintain its disposition with respect to the abutting member 261, the stop latch 260 is pivoted together with the abutting member 261, however to the opposite direction. I.e. towards the depression 259. This way, when the panel is closed the stop latch 260 is maintained in the secured position thereof.

In addition, the stop latch 260 can be spring biased for example by a torsion spring 275 which is configured to urge the stop latch 260 to pivot towards the frame element 252. Since the stop latch 260 is generally maintained pivoted towards the abutting member 261 under the forces of the contracting spring 277, when the torsion spring 275 urges the stop latch 260 to pivot towards the frame element 252 the abutting member 261 is pivoted towards the panel 250.

It is thus appreciated that the panel 250 in the closed position precludes the torsion spring 275 from pivoting the pivoting of the abutting member 261 and the stop latch 260. When the panel 250 is in the opened state thereof, the torsion spring 275 is free to pivot the stop latch 260 towards the frame element 252, while the abutting member 261 is pivoted away from the frame element 252. This way, when the panel is shut and is displaced towards the frame element 252, frame facing portion 257 of the panel 250 is not blocked by the stop latch 260 and the panel 250 is free to reach the frame element 252.

The actuation mechanism according to the present example includes a rotating actuator 270 having a bolt 272 mounted thereon off the rotational axis of the rotating actuator 270. The bolt 272 is configured to maintain engagement with an arm 265 coupled to the locking element 258. Thus, rotation of the rotating actuator 270 causes the bolt 272 to be displaced along a rotational path, such the arm 265 is displaced therewith, causing the locking element 258 to pivot in an alternating motion towards and away from the depression 259.

The rotating actuator 270 includes a cutaway portion 274 defined on a location on the outer periphery thereof. The cutaway portion 274 is configured such that when it is disposed adjacent the catch member 256 of the locking element 258 the stop latch 260 can be disposed at the secured position thereof, while resting on the cutaway portion 274, as shown in FIG. 8A. At this position the rotation of the rotating actuator 270 is precluded by the engagement of the bolt 272 and the arm 265, since the arm 265 and the locking element 258 to which the arm 265 is coupled, are secured by the stop latch 260 and cannot pivot to the unlocked position.

The actuation mechanism further includes a pushing rod 269 (configured to push the stop latch 260 to the released position thereof. Since at this position the abutting member 261 is blocked by the panel 250, and cannot pivot away from the frame element 252, the pushing rod 269 urges the stop latch 260 towards the frame element 252 against the forces of the contracting spring 277.

Thus, as shown in FIG. 8B, when the pushing rod 269 is pushed the hook 262 disengages the catch member 256 of the locking element 258 so that latter is no longer secured and can pivot to the unlocked position.

At this position the bolt 272 is no longer secured by the arm 265, as the locking element 258 can pivot away from the depression 259, accordingly, the bolt 272 can displaced allowing the rotating actuator 270. As shown in FIG. 8C, when the rotating actuator 270 rotates, the bolt 272 is displaced therewith along a rotational path, such that the arm 265 to which the bolt 272 is engaged, pivots back and forth. I.e. when the bolt 272 is displaced along a first half of the rotational path, the arm 265 is pivoted and the locking element is displaced away from the depression 259, when the bolt 272 is displaced along a second half of the rotational path, the arm 265 is pivoted and the locking element 258 is displaced towards the depression 259.

As shown in FIG. 8C, when the rotating actuator 270 rotates the cutaway portion 274 is rotated therewith, away from the catch member 256 of the locking element 258. Thus, at this position the stop latch 260 is engaged with the periphery of the rotating actuator 270 and is thus precluded from pivoting towards the catch member 256 to the secured position thereof. Accordingly, as shown in FIGS. 8D and 8E, the rotating actuator 270 can rotate further pushing therewith the arm 265 until the locking element 258 is pivoted to the unlocked position allowing the panel 250 to be opened.

As shown in FIG. 8E, further rotation of the rotating actuator 270 causes the arm and the locking element 258 to pivot back to the locked position. As the rotating actuator 270 completes one rotation the bolt 272 completes its rotational path and the cutaway portion 274 is disposed again adjacent the catch member 256 of the locking element 258. At this position the stop latch 260 is no longer engaged with the periphery of the rotating actuator 270 and it can pivot back to the secured position thereof in which it rests on the cutaway portion 274 and the hook 262 is engaged with the catch member 256 of the locking element 258.

As shown in FIGS. 8D and 8E, as the panel 250 is free to be discalced to the open state thereof, the abutting element is urged away from the frame element 252 under the forces of the contracting spring 277.

It is appreciated that the pushing rod 269 can be actuated manually, and the rotating actuator 270 can be configured to rotate automatically once the stop latch 260 is pivoted to the released position thereof.

Figure 9B:
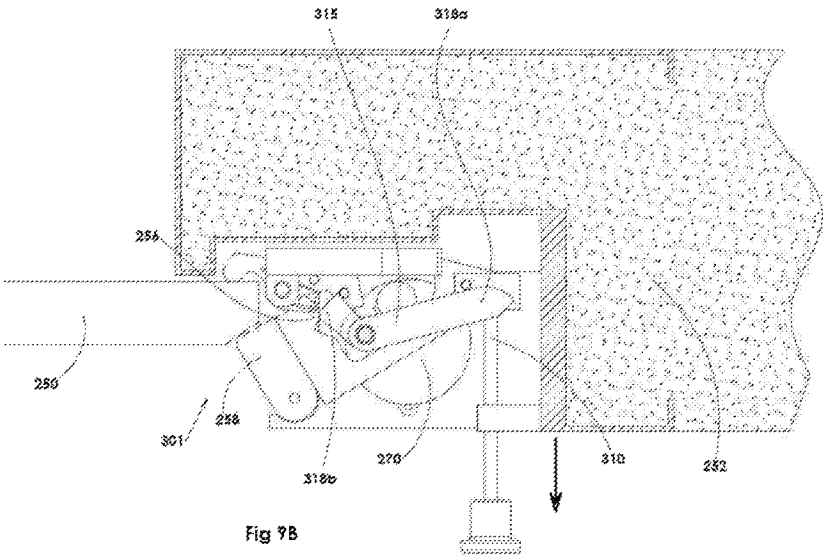
FIG. 9B is a top sectional view of the panel of FIG. 9A in a locked position of the latch arrangement.
Figure 9A:
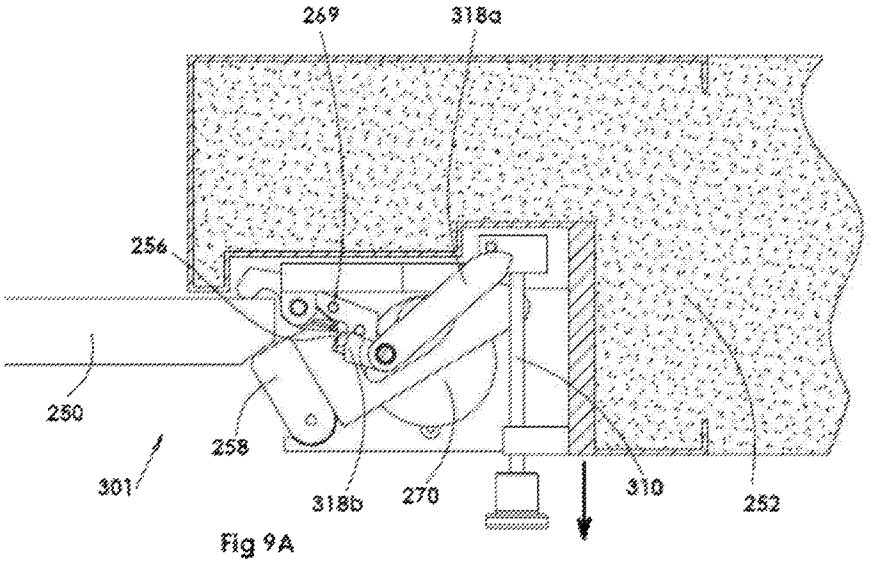
FIG. 9A is a top view of a panel having latch arrangement in accordance with another example of the presently disclosed subject matter.

FIGS. 9A to 9B illustrated a latch arrangement 301, substantially the same as the latch arrangement 251 of FIGS. 8A to 8E, wherein like references numerals designate like elements. The latch arrangement 301 includes a locking element 258 pivoting between a locked and unlocked position, and having an arm 265 engaging a bolt 272 mounted on a rotating actuator 270.

The latch arrangement 301 further includes a stop latch 260 pivotally mounted on the frame element 252 and having a hook 262 configured to engage in a secured position a catch member 256 of the locking element 258. As in the previous example, in the secured position, the stop latch 260 rests on a cutaway portion 274 of the rotating actuator 270 precluding thereby the rotation of the rotating actuator 270. According to the illustrated example, however, displacement of the stop latch 260 to the released position is carried out by a pulling rod 310, as opposed to the pushing rod 269 of the previous example. The pulling rod 310 can be coupled to a pivoting arm 315 configured to pivot such that a first portion 318*a* thereof is coupled to the pulling rod 310 while a second portion 318*b* thereof is configured to engage the stop latch 260 and to pivot the latter to the released position thereof. This way, the pulling rod 310 can be pulled, puling therewith the first portion 318*a* of the pivoting arm 315 causing the pivoting motion of the latter, such that the second portion 318*b* of the pivoting arm 315 urges the stop latch 260 away from the cutaway portion 274 of the rotating actuator 270. As a result the rotating actuator 270 is free to rotate and to cause the pivoting motion of the locking element 258 to the unlocked position as described in detail with respect to FIGS. 8*c* to 8E.

Figure 10C:
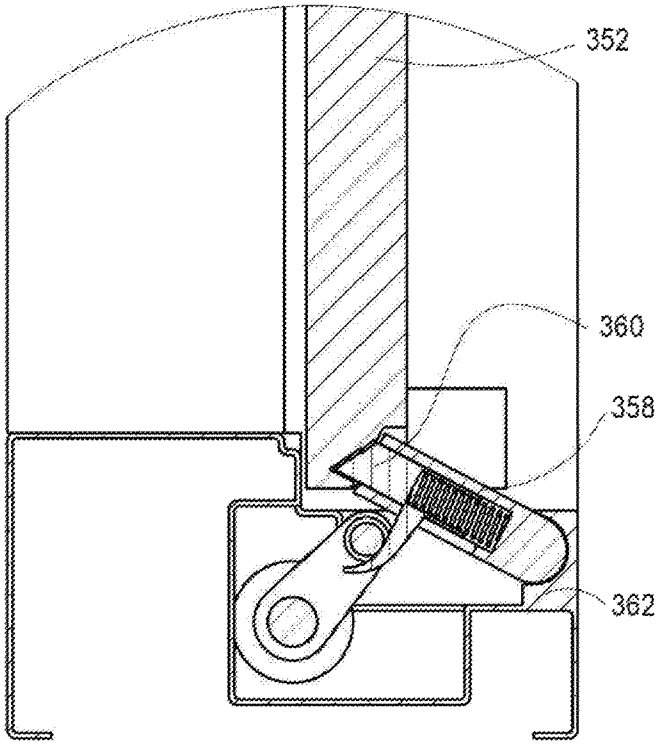
FIG. 10C is an enlarged view of the latch arrangement of FIG. 10B in the closed position.
Figure 10B:
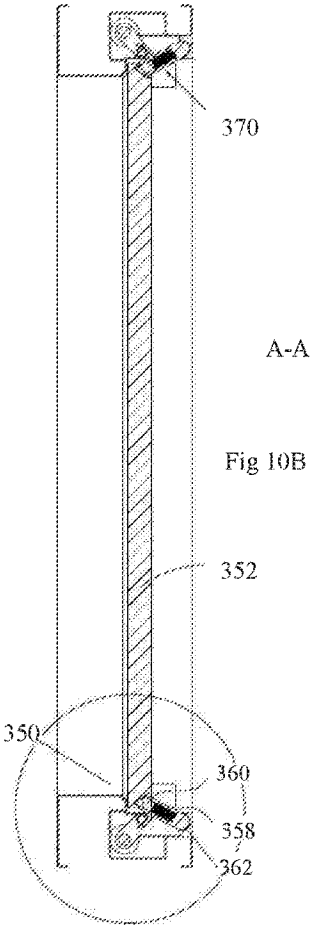
FIG. 10B is a side sectional view of the window of FIG. 10A taken along lines A-A.
Figure 10A:
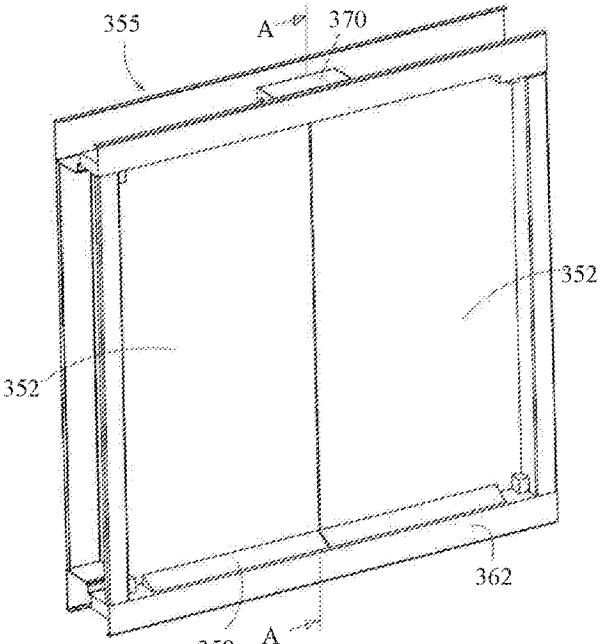
FIG. 10A is a perspective view of a window having a latch arrangement in accordance with another example of the presently disclosed subject matter.

FIGS. 10A to 10C, illustrate a latch arrangement 350 substantially that same as the latch arrangement 51 of FIGS. 3A to 3E, implemented for fastening a panel of a window 355, here illustrated as a double hinged window, having two hinged panels 352. The latch arrangement 350 includes a locking element 358 pivotally mounted on the frame element 362 of the window 355 and a stop latch 360 slidablely mounted inside the locking element 358 and configured to selectively engage a recesses formed along a dimension of the panels 352.

As shown in FIG. 10B, according to the illustrated example, in the locking position, the locking element 358 is configured to protrude from the frame element 362, such that the panels 352 cannot be opened. The locking element, according to the illustrated example extended along the majority of the bottom portion of the frame element 362 such the when in the closed position thereof, the locking element 358 engages both panels 352 precluding thereby opening thereof.

The second latch arrangement 370 is similar to the latch arrangement 350 mounted along the bottom frame element 362. This way in the locking position of the latch arrangements 350 and 370 both the top and bottom of the panels 352 are held secured in the closed state.

Those skilled in the art to which the presently disclosed subject matter pertains will readily appreciate that numerous changes, variations, and modifications can be made without departing from the scope of the invention, mutatis mutandis.

What is claimed is:

1. A latch arrangement for fastening between a pair of closure elements, said pair of closure elements including a panel of a door or a window and a frame element, the latch arrangement comprising:

a locking element pivotally mounted on a first of the closure elements and displaceable between a locked position in which said locking element is engaged with a second of the closure elements, thereby locking the second closure element to the first closure element, and an unlocked position in which said locking element is disengaged from the second closure element, thereby unlocking the second closure element from the first closure element, wherein said locking element in said locked position extends at an oblique angle with respect to the second closure element such that a first region of the locking element is configured to engage the second closure element while a second region of the locking element is supported by the first closure element;

a stop latch assuming a securing state to secure said locking element in said locked position, thereby precluding displacement of said locking element to the unlocked position, said stop latch being movable to a released state in which said locking element is free to be displaced to said unlocked position; and an actuating mechanism configured to selectively move said stop latch from said securing state towards said released state, thereby allowing said locking element to pivot out of engagement with the second closure element to said unlocked position, wherein, in said locked position, said locking element is positioned to engage said second closure element such that relative displacement of the first and second closure elements in an opening direction is opposed by compressive forces exerted on said locking element even when said stop latch is in said released state, and wherein said locking element is configured for progressively engaging the second closure element before the first and second closure elements have reached a fully closed relative position.

2. The latch arrangement according to claim 1 wherein said actuating mechanism is further configured to displace said locking element to said unlocked position.

3. The latch arrangement according to claim 2 wherein said actuating mechanism includes an actuating member displaceably mounted on the second closure element and configured to selectively move towards said stop latch and to displace said stop latch to said released state and said locking element to said unlocked position.

4. The latch arrangement according to claim 2 wherein said actuating mechanism includes a powered actuator configured to displace at least a portion of said stop latch such that said stop latch is disengaged from said locking element, and to displace said locking element to the unlocked position.

5. The latch arrangement according to claim 2 wherein said actuating mechanism includes a manually operated handle mounted on the first closure element and configured to sequentially shift said stop latch out of said securing state and to displace said locking element to said unlocked position.

6. The latch arrangement according to claim 1 wherein said actuating mechanism includes a manually operated handle that is mounted on the second closure element.

7. The latch arrangement according to claim 1 wherein said stop latch is mounted on said locking element and is configured to selectively engage an abutment feature defined on the second closure element such that displacement of said locking element to the unlocked position is precluded.

8. The latch arrangement according to claim 7 wherein said stop latch is slidably mounted on said locking element and is configured to slide between said securing state in which at least one portion thereof is engaged with said abutment feature and said released state in which said at least one portion is retracted away from said abutment feature such that said locking element is free to be displaced to said unlocked position.

9. The latch arrangement according to claim 8, wherein said abutment feature is a recess defined inside a depression in the second closure element.

10. The latch arrangement according to claim 1 wherein said stop latch is mounted on said locking element and is configured to selectively engage an abutment feature defined on the first closure element.

11. The latch arrangement according to claim 1 wherein said stop latch is pivotally mounted on said locking element and is configured to pivot between said securing state and said released state.

12. The latch arrangement according to claim 11 wherein said stop latch comprises an over-center linkage.

13. The latch arrangement according to claim 12 further comprising a pivoting actuator pivotally mounted to said locking element and deployed so as to displace said over-center linkage from a locked state to an unlocked state.

14. The latch arrangement according to claim 11 further comprising an abutment feature defined on the first closure element.

15. The latch arrangement according to claim 11 further comprising an actuating mechanism mounted on the second closure element and configured to selectively actuate said locking element, wherein said actuating mechanism includes a catch member and wherein in said securing state said stop latch is engaged with said catch member.

16. The latch arrangement according to claim 1 wherein said locking element is pivotally mounted on the first closure element and is configured to pivot about a first axis and wherein said stop latch includes a catch member and is pivotally mounted on the first closure element and is configured to pivot about a second axis, different than said first axis, and wherein said stop latch is configured to selectively pivot between said securing state in which said catch member is engaged with a corresponding portion of said locking element, and said released state in which said catch member is disengaged from said corresponding portion such that said locking element is free to be displaced to said unlocked position.

17. The latch arrangement according to claim 1 wherein said locking element includes at least two projecting surfaces in stepped relation to each other so as to successively engage the second closure element as said locking element moves from said unlocked position towards said locked position.

18. The latch arrangement according to claim 1, wherein said progressive engagement of said locking element with the second closure element before the second closure element has reached the fully closed position is effective so that the first and second closure elements cannot be displaced back towards an opened state.

19. A door or a window comprising:

a frame element;

a panel configured to close against a portion of said frame element; and the latch arrangement of claim 1 deployed to selectively fasten the panel to the frame element, wherein said panel is a sliding panel configured to slide towards and away from said frame element, between a closed state and an open state.

20. A door or a window comprising:

a frame element;

a panel configured to close against a portion of said frame element; and the latch arrangement of claim 1 deployed to selectively fasten the panel to the frame element, wherein said panel is a hinged panel configured to rotate towards and away from said frame element, between a closed state and an open state.

21. A latch arrangement for fastening a panel of a door or a window to a frame element, the latch arrangement comprising:

a locking element pivotally mounted on the frame element and displaceable between a locked position in which said locking element is engaged with the panel locking thereby the panel to the frame element, and an unlocked position in which said locking element is disengaged from the panel unlocking thereby the panel from the frame element, wherein said locking element in said locked position extends at an oblique angle with respect to the panel such that a first region of the locking element is configured to engage the panel while a second region of the locking element is supported by the frame element;

a stop latch assuming a securing state to secure said locking element in said locked position, precluding thereby displacement of said locking element to the unlocked position, said stop latch being movable to a released state in which said locking element is free to be displaced to said unlocked position; and an actuating mechanism configured to selectively move said stop latch from said securing state towards said released state, thereby allowing said locking element to pivot out of engagement with the panel to said unlocked position, wherein, in said locked position, said locking element is positioned to engage said panel such that displacement of the panel towards an opening direction of the panel is opposed by compressive forces exerted on said locking element even when said stop latch is in said released state, and wherein said locking element is configured for progressively engaging the panel before the panel has reached a fully closed position.

* * * * *